US008896648B2

(12) United States Patent
Omori et al.

(10) Patent No.: US 8,896,648 B2
(45) Date of Patent: Nov. 25, 2014

(54) LASER DRIVING UNIT AND IMAGE FORMING APPARATUS

(75) Inventors: Atsufumi Omori, Kanagawa (JP); Masaaki Ishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 189 days.

(21) Appl. No.: 13/046,841

(22) Filed: Mar. 14, 2011

(65) Prior Publication Data

US 2011/0228037 A1 Sep. 22, 2011

(30) Foreign Application Priority Data

Mar. 16, 2010 (JP) ..... 2010-058716
Oct. 19, 2010 (JP) ..... 2010-234877

(51) Int. Cl.

| | |
|---|---|
| ***B41J 2/385*** | (2006.01) |
| ***B41J 2/41*** | (2006.01) |
| ***B41J 2/435*** | (2006.01) |
| ***B41J 2/455*** | (2006.01) |
| ***B41J 2/47*** | (2006.01) |
| ***G03G 15/043*** | (2006.01) |

(52) U.S. Cl.

CPC ..... *G03G 15/043* (2013.01); *B41J 2/473* (2013.01); *G03G 2215/0404* (2013.01); *B41J 2/455* (2013.01)

USPC ..... 347/237; 347/130; 347/132; 347/236; 347/247

(58) Field of Classification Search

CPC ..... B41J 2/385; B41J 2/41; B41J 2/435; B41J 2/455; B41J 2/47

USPC ..... 347/111, 112, 129, 130, 132, 224, 225, 347/233, 236, 237, 247

See application file for complete search history.

(56) References Cited

U.S. PATENT DOCUMENTS

| | | | |
|---|---|---|---|
| 6,917,639 | B2 | 7/2005 | Ishida et al. |
| 6,933,957 | B2 | 8/2005 | Omori et al. |
| 7,136,404 | B2 | 11/2006 | Suda |
| 7,256,815 | B2 | 8/2007 | Suzuki et al. |
| 7,271,824 | B2 | 9/2007 | Omori et al. |
| 7,515,170 | B2 | 4/2009 | Omori et al. |
| 7,701,480 | B2 | 4/2010 | Omori et al. |

(Continued)

FOREIGN PATENT DOCUMENTS

| | | |
|---|---|---|
| JP | 04-283978 | 10/1992 |
| JP | 05-328071 | 12/1993 |

(Continued)

OTHER PUBLICATIONS

Japanese Office Action dated Jul. 15, 2014.

*Primary Examiner* — Justin Seo
*Assistant Examiner* — Kendrick Liu
(74) *Attorney, Agent, or Firm* — IPUSA, PLLC

(57) ABSTRACT

A laser driving unit drives a semiconductor laser apparatus including a plurality of light sources, includes a light detecting part to detect light emissions from the light sources, a driving current generator to generate a driving current based on an input signal, an auxiliary driving current generator to generate an auxiliary driving current in an initial time period of an ON-time of the driving current, and an auxiliary current set part to set an auxiliary amount of the auxiliary driving current to be added to the driving current, for each of the light sources, based on a difference between the light emissions detected by the light detecting part and a target light emission of the light sources.

25 Claims, 25 Drawing Sheets

(56) References Cited

U.S. PATENT DOCUMENTS

| | | | | |
|---|---|---|---|---|
| 2003/0035451 | A1* | 2/2003 | Ishida et al. | 372/38.02 |
| 2006/0285186 | A1 | 12/2006 | Ishida et al. | |
| 2007/0030548 | A1 | 2/2007 | Nihei et al. | |
| 2007/0132828 | A1 | 6/2007 | Ishida et al. | |
| 2007/0242127 | A1 | 10/2007 | Omori et al. | |
| 2008/0013578 | A1* | 1/2008 | Moriya | 372/38.02 |
| 2008/0088893 | A1 | 4/2008 | Ishida et al. | |
| 2008/0123160 | A1 | 5/2008 | Omori et al. | |
| 2008/0218813 | A1 | 9/2008 | Tanabe et al. | |
| 2008/0225106 | A1* | 9/2008 | Omori et al. | 347/237 |
| 2008/0239336 | A1 | 10/2008 | Tanabe et al. | |
| 2008/0291259 | A1 | 11/2008 | Nihei et al. | |
| 2008/0298842 | A1 | 12/2008 | Ishida et al. | |
| 2009/0091805 | A1 | 4/2009 | Tanabe et al. | |
| 2009/0167837 | A1 | 7/2009 | Ishida et al. | |
| 2009/0174915 | A1 | 7/2009 | Nihei et al. | |
| 2009/0195635 | A1 | 8/2009 | Ishida et al. | |
| 2009/0231656 | A1 | 9/2009 | Suzuki et al. | |
| 2009/0303451 | A1 | 12/2009 | Miyake et al. | |
| 2010/0045767 | A1 | 2/2010 | Nihei et al. | |
| 2010/0119262 | A1 | 5/2010 | Omori et al. | |
| 2010/0214637 | A1 | 8/2010 | Nihei et al. | |

FOREIGN PATENT DOCUMENTS

| | | |
|---|---|---|
| JP | H08-146736 | 6/1996 |
| JP | 09-083050 | 3/1997 |
| JP | 3466599 | 11/2003 |
| JP | 2003-344798 | 12/2003 |
| JP | 2004-142392 | 5/2004 |
| JP | 2004-333804 | 11/2004 |
| JP | 2009-262344 | 11/2009 |

* cited by examiner

FIG.3

| ILD[mA] | $V_{LDDOWN}$[V] | P[μW] |
|---|---|---|
| 0 | 0 | 0.018 |
| 0.25 | 1.437 | 0.25 |
| 0.5 | 1.471 | 0.56 |
| 0.75 | 1.492 | 0.9 |
| 1 | 1.507 | 1.26 |
| 1.5 | 1.529 | 2.02 |
| 2 | 1.545 | 2.83 |
| 3 | 1.568 | 4.52 |
| 4 | 1.585 | 6.4 |
| 5 | 1.598 | 8.33 |

FIG.6

| LIGHT SOURCE ID | DAC CODE |
|---|---|
| Id001 | X1 |
| Id002 | X2 |
| ⋮ | ⋮ |
| Id··· | X··· |

TARGET INTEGRATION VALUE 80

| INTEGRATION LIGHT QUANTITY | DAC SETTING OF OVERSHOOT CURRENT SOURCE |
|---|---|
| 50 | 0 |
| 80 | 20 |

TARGET INTEGRATION VALUE 92

| INTEGRATION LIGHT QUANTITY | DAC SETTING OF OVERSHOOT CURRENT SOURCE |
|---|---|
| 80 | 0 |
| 92 | 20 |

TARGET INTEGRATION VALUE 80

| INTEGRATION LIGHT QUANTITY | DAC SETTING OF OVERSHOOT CURRENT SOURCE |
|---|---|
| 50 | 0 |
| 80 | 20 |

TARGET INTEGRATION VALUE 88

| INTEGRATION LIGHT QUANTITY | DAC SETTING OF OVERSHOOT CURRENT SOURCE |
|---|---|
| 80 | 0 |
| 88 | 32 |

FIG.15

| PATTERN/LIGHT QUANTITY | P1 | P2 |
|---|---|---|
| 1by1 | 88 (16) | 92 (12) |
| 2by2 | 90 (14) | 94 (10) |
| 4by4 | 92 (12) | 96 (8) |

LASER DRIVING UNIT AND IMAGE FORMING APPARATUS

CROSS-REFERENCE TO RELATED APPLICATIONS

This application claims the benefit of Japanese Patent Applications No. 2010-58716 filed on Mar. 16, 2010 and No. 2010-234877 filed on Oct. 19, 2010, in the Japanese Patent Office, the disclosure of which is hereby incorporated by reference.

BACKGROUND OF THE INVENTION

1. Field of the Invention

The present invention generally relates to a laser driving unit and an image forming apparatus that includes such a laser driving unit.

2. Description of the Related Art

Conventional semiconductor laser driving circuits may be roughly categorized into a zero-biased (or non-biased) type and a biased type. The zero-biased type semiconductor laser driving circuit sets a bias current of a semiconductor laser to zero, and drives the semiconductor laser by a pulse current corresponding to an input signal. Examples of the zero-biased type semiconductor laser driving circuit are proposed in Japanese Laid-Open Patent Publications No. 4-283978 and No. 9-83050, for example.

When driving a semiconductor laser having a relatively large threshold current by the zero-based type semiconductor laser driving circuit, it takes a certain amount of time until a carrier concentration sufficient to cause laser oscillation is generated, even when a driving current corresponding to the input signal is applied to the semiconductor laser. As a result, delay is generated in the light emission from the semiconductor laser. The light emission delay does not cause a serious problem if a pulse width of the input signal is sufficiently wide compared to the light emission delay time such that the light emission delay is negligible. However, when the semiconductor laser is to be driven at a high speed in order to realize high-speed operation in equipments such as laser printers, optical disk drives, and digital copying apparatuses, for example, a pulse width of the light that is emitted from the semiconductor laser may not be made wide to an extent desired.

On the other hand, the biased type semiconductor laser driving circuit sets a bias current of the semiconductor laser to a threshold value. The semiconductor laser is driven by constantly flowing the bias current and adding a pulse current corresponding to the input signal. An amount of current corresponding to an oscillation threshold value is supplied to the semiconductor laser in advance when using the biased type semiconductor laser driving circuit, and thus, the light emission delay may be substantially eliminated. However, the semiconductor laser constantly emits light in a vicinity of the oscillation threshold value (for example, at 200 μW to 300 μW) even when the semiconductor laser is not driven. Hence, when the semiconductor laser driven by the biased type is used in optical communication, for example, the extinction ratio becomes small. In addition, when the semiconductor laser driven by the biased type is used in an image forming apparatus such as the laser printer and the digital copying apparatus, for example, a banding type noise may appear in a background portion of the paper that is subjected to the printing or copying.

Hence, in the optical communication, the zero-biased type semiconductor laser driving circuit is used in order to reduce the deterioration of the extinction ratio.

On the other hand, there are demands further improve the resolution of the laser printer, the optical disk drive, the digital copying, and the like. Accordingly, there are proposals to use a red semiconductor laser that emits light having a wavelength of 650 nm or, an ultraviolet semiconductor laser that emits light having a wavelength of 400 nm, for example. These semiconductor lasers require more time until the carrier concentration sufficient to cause laser oscillation is generated, when compared to the conventionally used semiconductor lasers that emit light having wavelengths on the order of 1.3 μm, 1.5 μm, and 780 nm. For this reason, even if the semiconductor laser that emits light having the wavelength on the order of 650 nm or 400 nm is driven the biased type, the pulse width of the light that is emitted from the semiconductor laser may not be made wide to the extent desired.

Further, when a low tone is to be reproduced on the paper by the image forming apparatus using the light having a narrow pulse width on the order of several ns (nano-seconds) or less, for example, the output of the semiconductor laser may not reach its peak intensity. Consequently, the low tone that is actually reproduced may become lower than originally intended, and a correct tone reproduction may be difficult to achieve.

In order to suppress the problem related to the tone reproduction, a Japanese Laid-Open Patent. Publication No. 5-328071 proposes correcting the tone of a low tone region by superimposing a differential pulse on a rising edge of the driving current. However; this proposed technique cannot control a peak of the differential pulse, and the semiconductor laser may break down. In addition, because the time in which the differential pulse is superimposed on the driving current is dependent on a differential waveform, the tone of the low tone region may only be improved at an initial stage of the correction, and the gradation representation may not increase linearly after the initial stage of the correction.

In addition, a Japanese Patent No. 3466599 proposes a correction using a bias current, an oscillation threshold current, a light emission current, and an auxiliary driving current, in order to suppress the problem associated with the proposed technique that superimposes the differential pulse on the driving current. According to the proposed technique that uses four currents for the correction, the driving current may have a waveform approximating an ideal rectangular waveform. However, depending on the settings of the bias current and the oscillation threshold current, the pulse width of the optical waveform may become narrower than the pulse width of the input signal.

In a case where the semiconductor laser includes a plurality of light sources, a parasitic capacitance of a wiring differs among the light sources, because a wiring length between a driving circuit and each light source and a wiring length within each light source differ among the light sources. Thus, the narrowing of the pulse width of the optical waveform may differ among the light sources due to the parasitic capacitance that differs among the light sources. The difference in the quantities of light (or luminous energies) emitted from the light sources tends to increase as the narrowing of the pulse width of the optical waveform increases due to the effects of the parasitic capacitance that differs among the light sources.

In the image forming apparatus, the semiconductor laser that is popularly used may be a laser diode, a semiconductor laser array, a VCSEL (Vertical Cavity Surface Emitting Laser), and the like. An optical waveform response characteristic of the semiconductor laser may differ depending on the structure, wavelength characteristic, output characteristic, and the like of the semiconductor laser.

When the semiconductor laser is mounted on a circuit board together with the driving circuit, the wiring is formed between the semiconductor laser (or each of the light sources included in the semiconductor laser) and the driving circuit, and within a package of the semiconductor laser. The wirings include varying factors that affect the optical waveform response characteristic, such as the parasitic capacitance, inductance, and resistance components. Particularly in the case of a semiconductor laser having a relatively large package size, the parasitic capacitance may increase considerably, and the resistance component may increase considerably depending on the wavelength region. In other words, the optical waveform response characteristic of the semiconductor laser may vary depending on such varying factors.

For example, the differential resistance of the red semiconductor laser in the 650 nm wavelength region is large compared to the infrared semiconductor laser in the 780 nm wavelength region. Hence, a high-speed response of the optical waveform may not be obtained from the semiconductor laser and the response of the optical waveform may be slow, depending on the structure of the driving circuit, the circuit board, and the like.

In addition, in the case of the VCSEL, the differential resistance is extremely large compared to the edge-emitting semiconductor laser having the differential resistance on the order of approximately several hundred Ohms, because the structure of the VCSEL differs considerably from the structure of other infrared edge-emitting semiconductor lasers. For this reason, because of the time constant generated by the terminal capacitance of the VCSEL itself, the parasitic capacitance of the circuit board (or substrate) on which the VCSEL is mounted, the terminal capacitance of the driving circuit mounted on the circuit board, and the differential resistance of the VCSEL, the optical waveform with a high-speed response may not be obtained even if the VCSEL itself has a device characteristic and a cutoff characteristic that enable a high-speed modulation, after the VCSEL is mounted on the circuit board.

When the semiconductor laser having the above described varying factors include a plurality of light sources, the response characteristic of the light source may differ considerably among the light sources. The different response characteristics of the light sources cause differences in the oscillation delay and a transition time in which the light emission quantity varies. As a result, when the semiconductor laser is used in the image forming apparatus, for example, these differences may cause inconsistencies in the tone reproduction, color registration error, and the like.

Moreover, in the semiconductor laser, the amount of change in the light emission level with respect to the amount of change in the driving current differs between a LED (Light Emitting Diode) region in which the driving current changes from zero to the threshold value, and a LD (Laser Diode) region in which the driving current is greater than the threshold value. For this reason, when driving the semiconductor laser in the image forming apparatus by increasing the driving current from a state in which the applied bias current is less than the threshold value to the light emission stage, the oscillation delay may occur with respect to the driving current because of the low light emission level in the LED region.

SUMMARY OF THE INVENTION

Accordingly, it is a general object in one embodiment of the present invention to provide a novel and useful laser driving unit and image forming apparatus, in which the problems described above may be suppressed.

Another and more specific object in one embodiment of the present invention is to provide a laser driving unit and an image forming apparatus, that may correct a driving current depending on a light emission state of a light source.

According to one aspect of the present invention, there is provided a laser driving unit configured to drive a semiconductor laser apparatus including a plurality of light sources, including a light detecting part configured to detect light emissions from the plurality of light sources, a driving current generator configured to generate a driving current based on an input signal, an auxiliary driving current generator configured to generate an auxiliary driving current in an initial time period of an ON-time of the driving current, and an auxiliary current set part configured to set an auxiliary amount of the auxiliary driving current to be added to the driving current, for each of the plurality of light sources, based on a difference between the light emissions detected by the light detecting part and a target light emission of the plurality of light sources.

According to another aspect of the present invention, there is provided an image forming apparatus including, in addition to the laser driving unit, a photoconductive body, and the plurality of light sources configured to emit beams that scan the photoconductive body.

Other objects and further features of the present invention will be apparent from the following detailed description when read in conjunction with the accompanying drawings.

BRIEF DESCRIPTION OF THE DRAWINGS

FIG. 3 is a diagram illustrating values included in characteristics illustrated in FIGS. 2A and 2B;

FIG. 6 is a diagram illustrating a data structure of DAC codes used in the semiconductor laser driving unit in the embodiment;

FIG. 15 is a diagram for explaining an example of a relationship of the ON-pattern, a target integration value, and the DAC code for the semiconductor laser driving unit in the embodiment;

DESCRIPTION OF THE PREFERRED EMBODIMENTS

Figure 1:
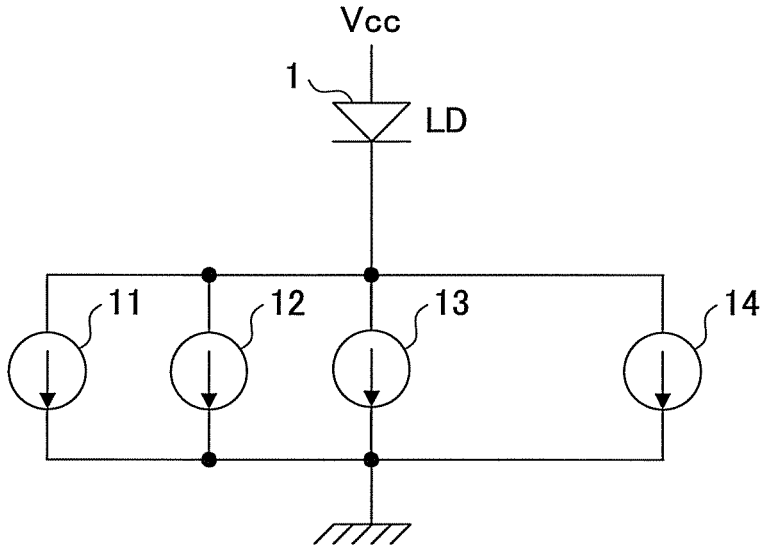
FIG. 1 is a circuit diagram or explaining semiconductor laser in an embodiment of the present invention.

A description will be given of embodiments of a laser driving unit and an image forming apparatus according to the present invention, by referring to the drawings. The laser driving unit may be used in various apparatuses that include laser light sources. Examples of such apparatuses include a laser printer, an optical disk drive, a digital copying apparatus, and an optical communication apparatus. The digital copying apparatus may include the so-called MFP (Multi-Function Peripheral).

FIG. 1 is a circuit diagram for explaining a semiconductor laser in an embodiment of the present invention. As illustrated in FIG. 1, a semiconductor laser driving unit includes four current sources to drive a semiconductor laser (hereinafter referred to as a LD (Laser Diode) 1. The four current sources include a threshold current source 11, a bias current source 12, a modulation current source 13, and an initial ON modulation current source 14.

A bias current output from the bias current source 12 may be approximately 1 mA, and approximately several mA at the most. A threshold current output from the threshold current source 11 corresponds to a threshold current of the LD 1. If the bias current output from the bias current source 12 is relatively large, the threshold current output from the threshold current source 11 may be set to a current value obtained by subtracting the bias current value from the threshold current value of the LD 1. The initial ON modulation current source 14 outputs an initial ON modulation current (hereinafter referred to as an overshoot current) having a magnitude proportional to a modulation current output from the modulation current source 13 for a short initial time period (for example, 0.5 ns to 5 ns) in which the modulation current turns ON.

Accordingly, the semiconductor laser driving unit illustrated in FIG. 1 outputs a sum of the four currents, namely, the bias current, the threshold current, the modulation current, and the overshoot current.

Figure 2A:
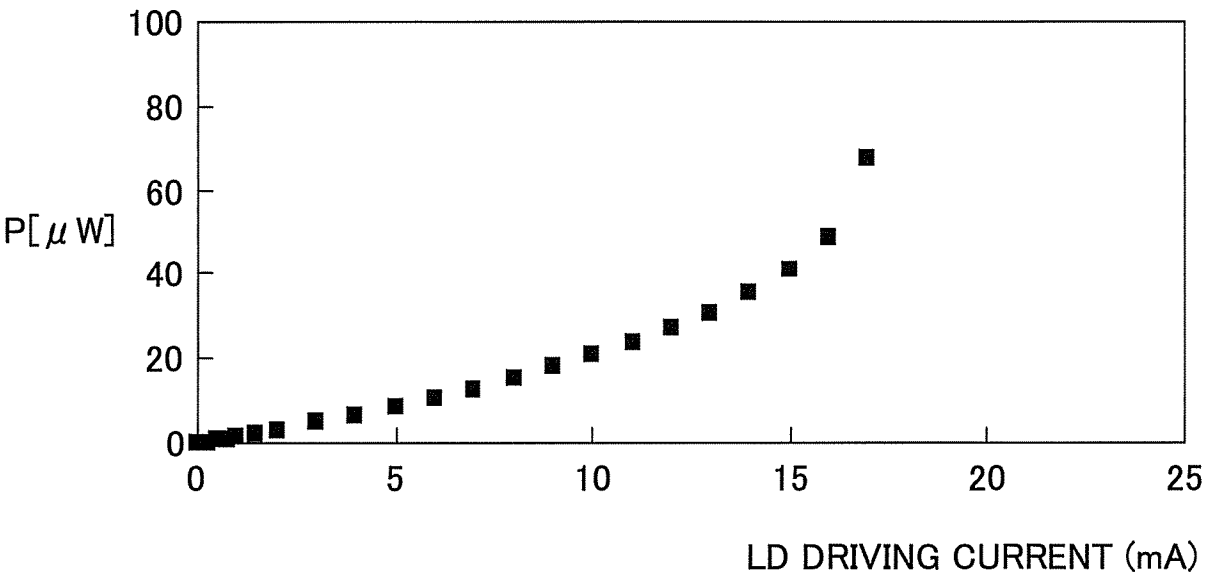
FIGS. 2A and 2B are diagrams respectively illustrating measured results of an optical output and a laser diode bias voltage for a case where a small current is applied to a laser diode.
Figure 2B:
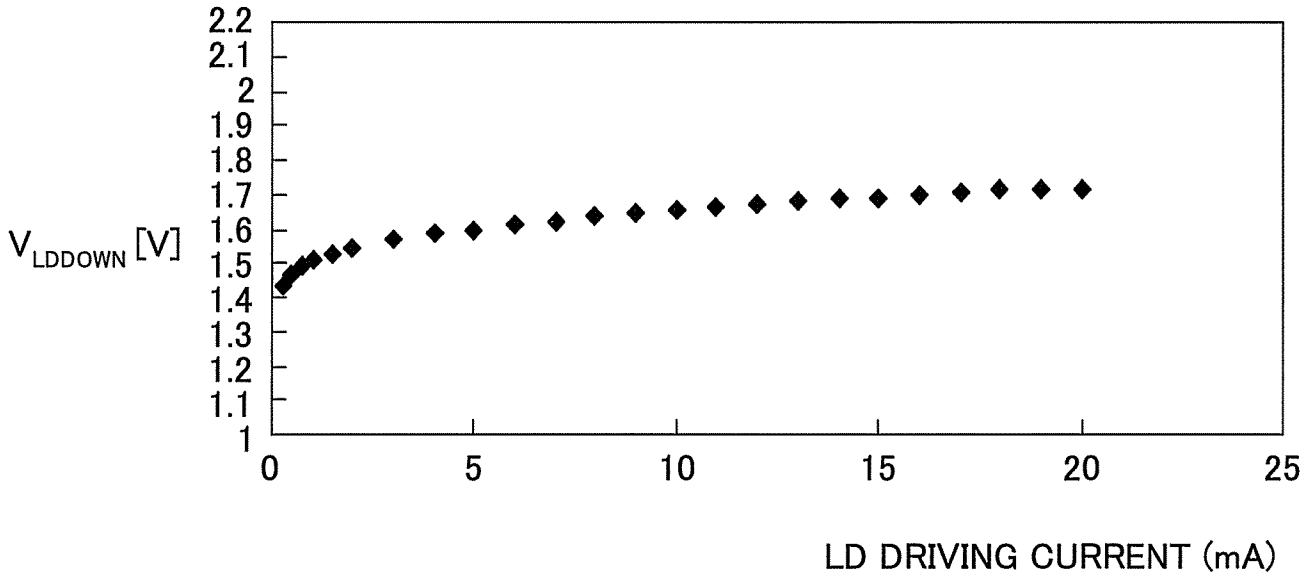

Next, a description will be given of the bias current of the LD 1, by referring to FIGS. 2A, 2B, and 3. FIGS. 2A and 2B are diagrams respectively illustrating measured results of an optical output P (μW) and a LD (Laser Diode) bias voltage $V_{LDDOWN}$ (V) for a case where a small current is applied to the LD 1. FIG. 3 is a diagram illustrating values included in characteristics illustrated in FIGS. 2A and 2B.

As illustrated in FIGS. 2A, 2B, and 3, the LD bias voltage $V_{LDDOWN}$ is already approximately 1.4 V when the LD current $I_{LD}$ is approximately 250 μA. The LD bias voltage $V_{LDDOWN}$ increases as the LD current $I_{LD}$ increases, because the LD 1 includes a DC resistance component. The LD bias voltage $V_{LDDOWN}$ is zero (0) when the LD current $I_{LD}$ is zero (0), but the LD bias voltage $V_{LDDOWN}$ increases to approximately 1.4 V when the LD current $I_{LD}$ increases to approximately 250 μA, and the LD bias voltage $V_{LDDOWN}$ gradually increases thereafter as the LD current $I_{LD}$ increases. Hence, it may be regarded that the impedance of the LD 1 becomes sufficiently small by applying to the LD 1 the LD current $I_{LD}$ that is only approximately 250 μA, and that the response characteristic is sufficiently improved when the threshold current is next applied. In other words, it may be regarded that, by applying the small bias current of approximately 1 mA, a high-speed response of the LD 1 may be achieved without causing a substantial change in the LD bias voltage $V_{LDDOWN}$ of the LD 1.

The optical output of the LD 1 is 1.26 μW even when the LD current $I_{LD}$ is 1 mA. Considering the fact that the light emission quantity of the LD 1 is normally 1 mW or greater, the 1.26 μW optical output is only on the order of 0.1% of the normal light emission quantity and is very low. Accordingly, when the LD 1 driven by the above semiconductor laser driving unit is used in optical communication, for, example, the extinction ratio may be prevented from becoming small because the 1.26 μW optical output is very low. In addition, when the LD 1 driven by the above semiconductor laser driving unit is used in the image forming apparatus such as the laser printer and the digital copying apparatus, for example, the banding type noise may be prevented from appearing in the background portion of the paper that is subjected to the printing or copying because the 1.26 μW optical output is very low.

In addition, when driving by the above semiconductor laser driving unit a semiconductor laser formed by a LD array that includes a plurality of LDs 1 but only a single PD (Photo-Diode), it may be regarded that no serious problem is introduced even if during the light quantity control of one LD 1 the other LDs 1 produce an optical output of approximately 1 μW.

FIGS. 2A, 2B, and 3 illustrate the measured results for an example of the LD 1. However, other examples of the LD 1 may have characteristics similar to that of the example of the LD 1 for which the measured results are illustrated, and thus, the other examples of the LD 1 may be driven in a manner similar to the above.

The response speed of the LD in response to the current applied thereto may differ depending on the type (or kind) of LD. In the type of LD having response speed that is sufficiently high even from a zero-current state, the high-speed response of the LD may be achieved by simply applying the threshold current, the modulation current, and the overshoot current, without the need to apply the small bias current described above. Further, a satisfactory beam spot may be formed by the output of the LD by simply applying the threshold current, the modulation current, and the overshoot current, without the need to apply the small bias current described above.

However, the recent trend is for the optical output wavelength of the LD to become shorter, particularly when used in the image forming apparatus, in order to achieve a high resolution. For example, the optical output wavelength of the LD used in the laser printer or digital copying apparatus may be shortened from 780 nm of the infrared to 650 nm of the red or even to 500 nm of the blue. In general, the shorter the optical output wavelength of the LD, the longer the response time and the slower the response speed of the LD. Because the DC resistance component increases when the response speed of the LD becomes slower, the effect of applying the small bias current to the LD becomes greater. In addition, the time in which the threshold current is applied to the LD may be reduced by applying the small bias current to the LD. Consequently, the time in which the banding type noise may appear in the background portion of the paper that is subjected to the printing or copying may further be reduced, and the quality of the image obtainable by the laser printer or digital copying apparatus may further be improved.

Figure 4:
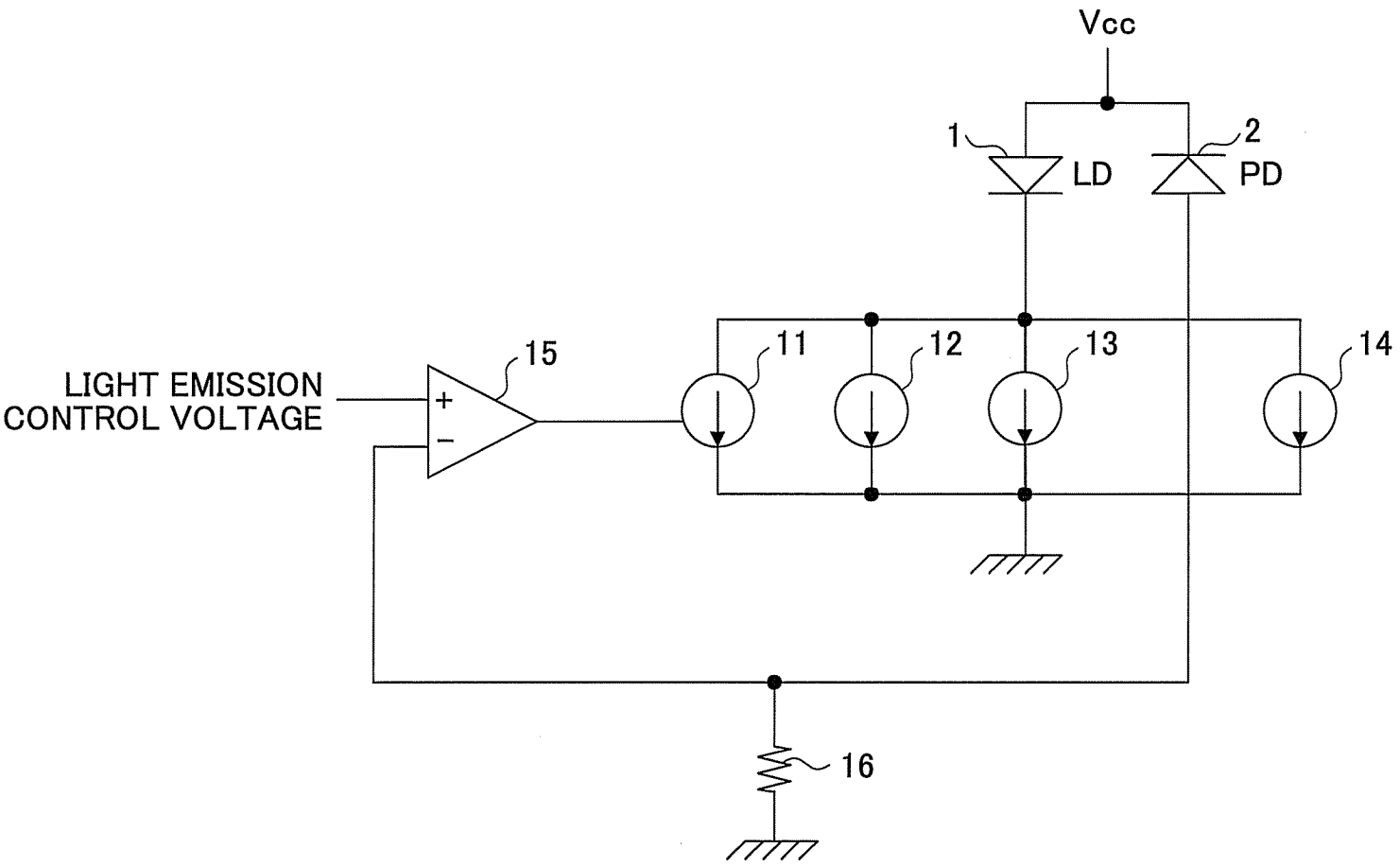
FIG. 4 is a circuit diagram illustrating a basic structure of a semiconductor laser driving unit with controllable threshold current.

FIG. 4 is a circuit diagram illustrating a basic structure of the semiconductor laser driving unit with controllable threshold current. In general, the threshold current of the LD greatly changes depending on the temperature. For this reason, it is either necessary to constantly control the threshold current or, to control the threshold current using a sample and hold circuit, for example. On the other hand, the bias current may be a small fixed current. Moreover, the change in the modulation current due to the temperature may be small if the characteristic unique to the LD is measured during the initial setting and the modulation current is set according to the measured characteristic. Hence, the modulation current may also be a fixed current.

Accordingly, the semiconductor laser driving unit illustrated in FIG. 4 includes a PD 2 to receive the optical output of the LD 1, the threshold current source 11, the bias current source 12, the modulation current source 13, the initial ON modulation current source 14, a comparator 15, and a resistor 16. The resistor is provided to convert the current value to be applied to the PD 2 into a voltage value. In the semiconductor laser driving unit illustrated in FIG. 4, the comparator 15 compares a voltage across both terminals of the resistor 16 with a reference value (or light emission control voltage), and an output of the comparator 15 is used to control the output threshold current of the threshold current source 11.

Although only one LD 1 is illustrated as the light source in FIG. 4, the light source is of course not limited to the LD and the number of light sources is of course not limited to one. For example, the light source may be a surface emission laser. In addition, in the case of a semiconductor laser apparatus having a plurality of light sources, such as the VCSEL and the LD array, for example, a plurality of LDs 1 illustrated in FIG. 4 may be provided. In this case, a circuit part at least including the threshold current source 11, the bias current source 12, the modulation current source 13, and the initial ON modulation current source 14 may be provided with respect to each of the plurality of LDs 1.

Figure 5:
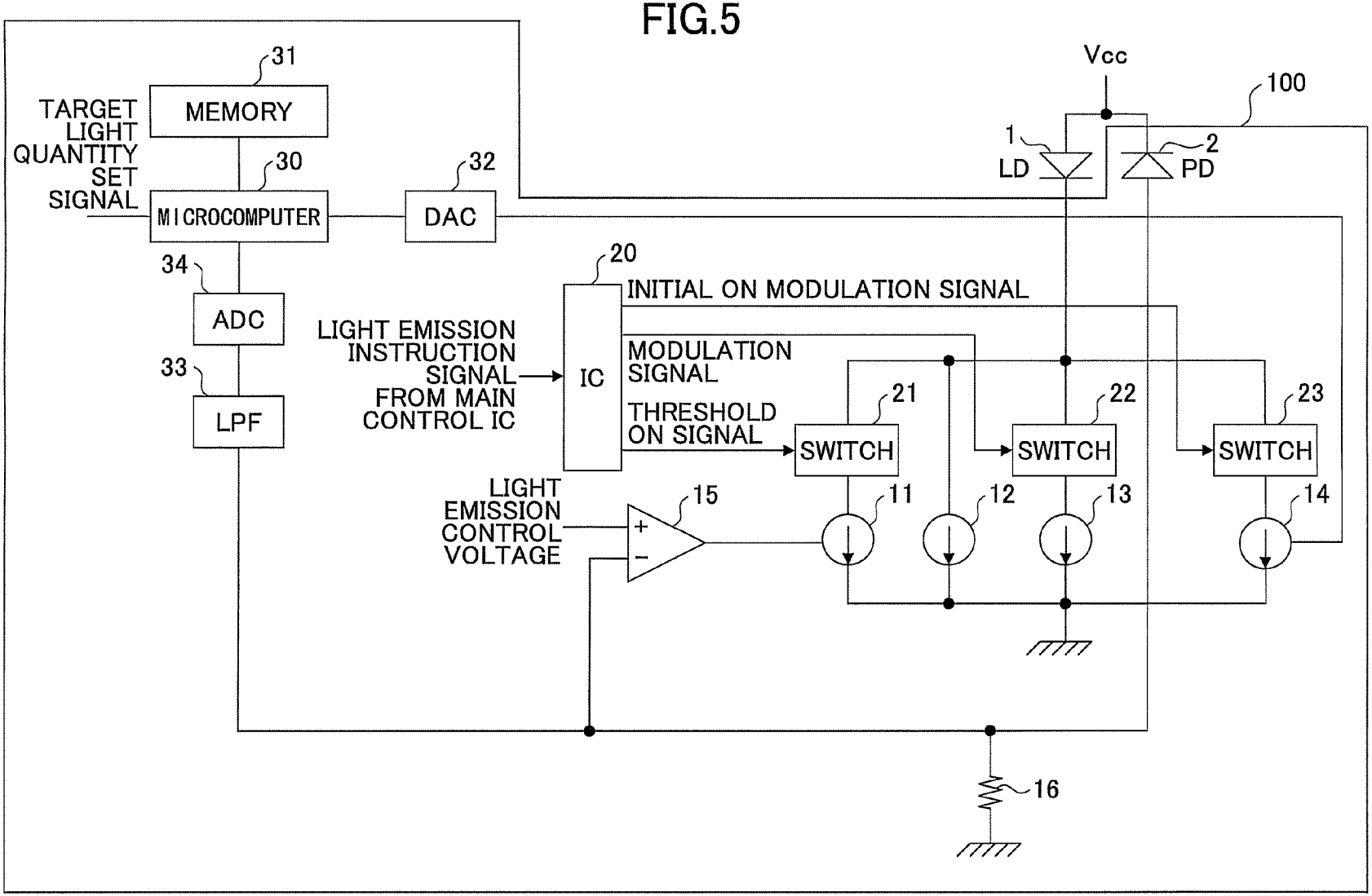
FIG. 5 is a diagram illustrating the structure of the semiconductor laser driving unit in the embodiment.

Next, a description will be given of the structure of the semiconductor laser driving unit in the embodiment, by referring to FIG. 5. FIG. 5 is a diagram illustrating the structure of the semiconductor laser driving unit in the embodiment.

A semiconductor laser driving unit 100 illustrated in FIG. 5 has a structure in which the driving current for the LD 1 is generated from a modulation signal, a threshold ON signal, and an initial ON modulation signal via switches.

In this example, the semiconductor laser driving unit 100 includes a PD 2, a threshold current source 11, a bias current source 12, a modulation current source 13, an initial ON modulation current source 14, a comparator 15, a resistor 16, an IC (Integrated Circuit) 20, switches 21 through 23, a microcomputer 30, a memory 31, a DAC (Digital-to-Analog Converter) 32, a LPF (Low-Pass Filter) 33, and an ADC (Analog-to-Digital Converter) 34 that are connected as illustrated in FIG. 5. A circuit part excluding the resistor 15, the microcomputer 30, and the memory 31 may be formed by an ASIC (Application Specific Integrated Circuit). In other words, the ASIC may form a circuit part including the threshold current source 11, the bias current source 12, the modulation current source 13, the initial ON modulation current source 14, the comparator 15, the IC 20, the switches 21 through 23, the DAC 32, the LPF 33, and the ADC 34. In this example, the semiconductor laser driving unit 100 and the LD 1 form a semiconductor laser apparatus.

In this example, a plurality of light sources may be provided, as in the case of the VCSEL or the LD array. In this case, a plurality of LDs 1 are provided. Further, a circuit part including the PD 2, the threshold current source 11, the bias current source 12, the modulation current source 13, the initial ON modulation current source 14, the comparator 15, the resistor 16, the switches 21 through 23, the DAC 32, the LPF 33, and the ADC 34 may be provided with respect to each LD 1.

In addition, the IC 20, the microcomputer 30, and the memory 31 may be provided in common with respect to the plurality of LDs 1. A single PD 2 may be provided in common to the plurality of LDs 1 or, one PD 2 may be provided with respect to each of the plurality of LDs 1. In other words, the structure of the semiconductor laser driving unit 100 may be modified depending on the structure of the semiconductor laser or the semiconductor laser apparatus.

The threshold current source 11 supplies the threshold current, and the bias current source 12 supplies the bias current having the bias level. The modulation current source 13 supplies the modulation current that may be used as a driving current to cause light emission of the LD 1 depending on the modulation signal (or input signal). Hence, the modulation current source 13 forms a driving current generator. The initial ON modulation current source 14 supplies the overshoot current during the initial time period of the ON-time of the modulation current (or driving current) supplied from the modulation current source 13. The initial ON modulation current source 14 forms an auxiliary driving current generator to generate, as the overshoot current, an auxiliary driving current that assists the modulation current (or driving current).

A light emission instruction signal that is input to the IC 20 is generated in a main control IC (not illustrated) that is provided in a stage preceding the IC 20. The light emission instruction signal is generated by the main control IC based on image data and a clock signal (for example, a pixel clock), in order to cause the LD 1 to emit light. The comparator 15 compares the voltage value of the resistor 16 with the reference value (or light emission control voltage). The output of the comparator 15, indicating the comparison result, controls the threshold current supplied from the threshold current source 11.

The switches 21, 22, and 23 are respectively provided between the LD 1 and the corresponding current sources 11, 13, and 14. For example, the switches 21 through 23 may be formed by transistors. ON and OFF states of the switches 21 through 23 may be controlled by outputs of the IC 20.

The microcomputer 30 forms an auxiliary driving current set part to set a current value (or auxiliary value) of the modulation current (or driving current) by the overshoot current (or auxiliary driving current), based on a difference between the light emission quantity detected by a light detecting part that is formed by the PD 2 and a target light emission quantity of the light source that is formed by the LD 1. The microcomputer 30 may set the overshoot current with respect to the LD 1 or, with respect to each of the plurality of LDs 1. The memory 31, the DAC 32, and the ADC 34 are connected to the microcomputer 30. The LPF 33 is connected to the microcomputer 30 via the ADC 34.

The memory 31 may store data used for controlling the overshoot current. The DAC 32 is connected to the initial ON modulation current source 14, and converts digital data stored in the memory 31 into analog data when the microcomputer 30 controls the overshoot current. The LPF 33 integrates the voltage across the terminals of the resistor 15, and an integration output of the LPF 33 is supplied to the ADC 34. The voltage value integrated by the LPF 33 corresponds to the integration value of the light quantity detected by the PD 2. The ADC 34 converts the analog integration value of the light quantity detected by the PD 2, output from the LPF 33, into a digital value that is supplied to the microcomputer 30. This digital value will hereinafter also be referred to as the integration value of the light quantity detected by the PD 2.

In the semiconductor laser driving unit 100, the IC 20 controls the ON and OFF states of the switches 21 through 23 when controlling the threshold current, the modulation current, and the initial ON modulation current. In order to carry out this control, the microcomputer 30 compares the integration value of the light quantity detected by the PD 2 with a target value indicated by a target light quantity set signal. The microcomputer 30 controls the output overshoot current of the initial ON modulation current source 14 via the DAC 32 so that the integration value of the light quantity input from the ADC 34 becomes equal to the target value indicated by the target light quantity set signal or, so that a difference between the integration value of the light quantity input from the ADC 34 and the target value indicated by the target light quantity set signal falls within a predetermined range.

The memory 31 stores DAC codes for adjusting the amount of the overshoot current output from the initial ON modulation current source 14. In this embodiment, the semiconductor laser driving unit 100 may correct the modulation current (or driving current) by adjusting the amount of the overshoot current (or auxiliary driving current). The DAC codes indicate the current values of the overshoot current, and may be determined based on the difference between the digital integration value of the light quantity output from the ADC 34 and the voltage value of the target light quantity set signal. For example, the DAC codes may be 4-bit codes, and the DAC codes may be set for each of the plurality of LDs 1 when more than one LDs 1 are provided. The value of the DAC code will hereinafter also be referred to as a set value of the DAC code.

FIG. 6 is a diagram illustrating a data structure of the DAC codes used in the semiconductor laser driving unit in the embodiment. Because more than one LDs 1 are provided, a light source ID (or identifier) is allocated to each LD 1, and the light source ID and the DAC code are stored in a related manner within the memory 31. In FIG. 6, the values of the light source ID are denoted by reference characters "id" followed by consecutive numbers (for example, 001, 002, . . . ), and the values of the DAC codes are denoted by a reference character "X" followed by consecutive numbers (for example, 1, 2, . . . ).

The microcomputer 30 reads the DAC code from the memory 31, and controls the output overshoot current of the initial ON modulation current source 14 via the DAC 32. The DAC code is converted by the DAC 32 into an analog value indicating the overshoot current value and input to the initial ON modulation current source 14. As a result, the initial ON modulation current source 14 outputs the overshoot current depending on the DAC code.

Next, a description will be given of a case where the LD 1 forming the light source is driven by the plurality of current sources using a predetermined ON pattern. In this example, the ON-pattern indicates the ON or OFF state of each pixel. The overshoot current may be set by the DAC code described above.

Figure 7:
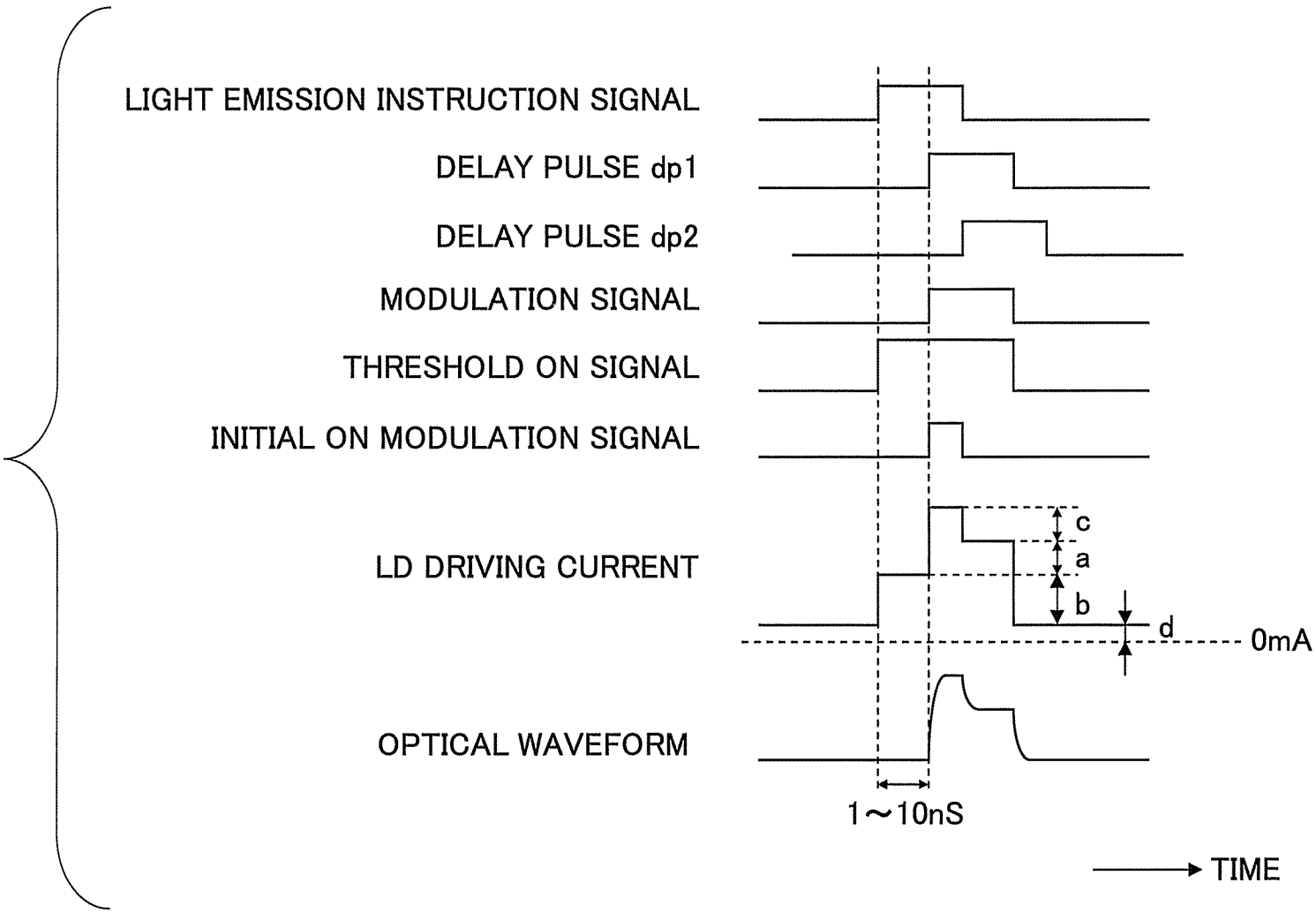
FIG. 7 is a timing chart for explaining an operation of the semiconductor laser driving unit in the embodiment.
Figure 8:
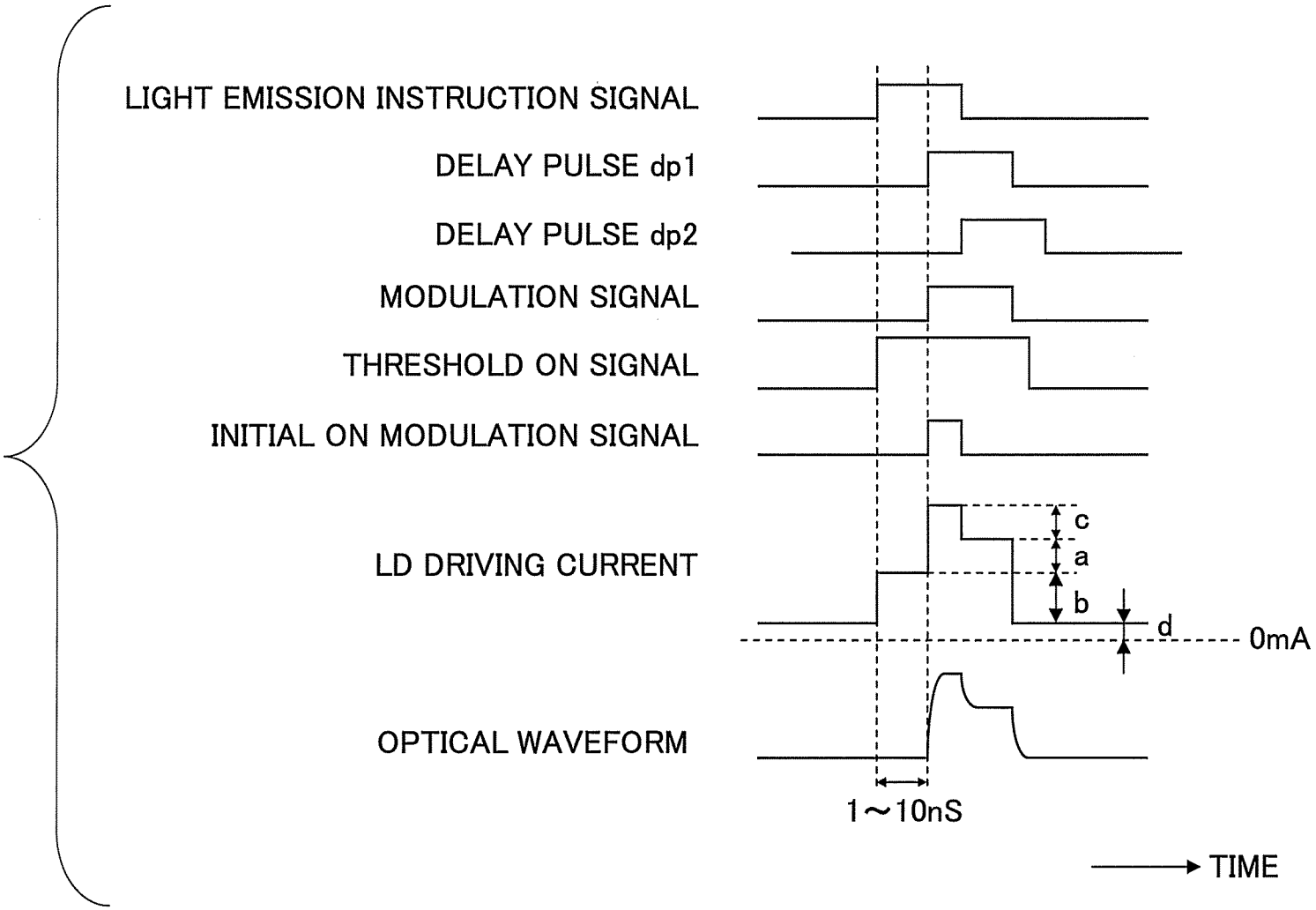
FIG. 8 is a timing chart for explaining the operation of the semiconductor laser driving unit in a modification of the embodiment.

FIGS. 7 and 8 are timing charts for explaining an operation of the semiconductor laser driving unit in the embodiment. In FIGS. 7 and 8 and subsequent figures illustrating waveforms, the ordinate and the abscissa indicate the respective parameters in arbitrary units unless otherwise indicated. Delay pulses dp1 and dp2 are generated based on the light emission instruction signal. The light emission instruction signal, and the delay pulses dp1 and dp2 may be used as driving signal to cause light emission from the LD 1. The delay pulses dp1 and dp2 may be generated within the IC 20 based on the light emission instruction signal that is input to the IC 20 from the main control IC.

In FIG. 7, the modulation signal indicates the signal waveform of the modulation current output from the modulation current source 13. The threshold ON signal indicates the signal waveform of the threshold current output from the threshold current source 11. The initial ON modulation signal indicates the signal waveform of the overshoot current output from the initial ON modulation current source 14. Because the delay pulse dp1 is used as the modulation signal in this example, the signal waveforms of the modulation signal and the delay pulse dp1 are the same in this example.

The LD driving current in FIG. 7 corresponds to a sum of the four currents, namely, the modulation current, the threshold current, the overshoot current, and the bias current. The optical waveform indicates the light intensity of the light emitted from the LD 1 that is driven by the LD driving current. The modulation current component is denoted by "a", the threshold current component is denoted by "b", the overshoot current component is denoted by "c", and the bias current component is denoted by "d". For the sake of convenience, FIG. 7 illustrates each of the components "a" through "d" on an enlarged scale.

The threshold ON signal is generated within the IC 20 from a logical sum (that is, OR) of the light emission instruction signal and the delay pulse dp1. On the other hand, the initial ON modulation signal is generated within the IC 20 from a logical product (that is, AND) of the delay pulse dp1 and an inverted pulse of the delay pulse dp2. The delays used to generate the delay pulses dp1 and dp2 may be realized by a series of inverters or a series of buffers or, by a lowpass filter including a resistor and a capacitor. The output of the lowpass filter in this case may be subjected to a waveform shaping. Regardless of how the delays are generated, the amount of delay may easily be changed by changing the number of stages forming the series of inverters or buffers or, by changing the time constant of the lowpass filter.

As described above, the LD driving current in FIG. 7 corresponds to a sum of the four currents, namely, the modulation current, the threshold current, the overshoot current, and the bias current. In addition, the threshold ON signal turns ON (that is, makes a transition to a high level) 1 ns to 10 ns before the modulation signal, and turns OFF (that is, makes a transition to a low level) simultaneously as the modulation signal. The difference between the ON-times of the threshold ON signal and the modulation signal is preferably as small as possible. However, when the semiconductor laser driving unit 100 is used in the image forming apparatus, such as the laser printer and the digital copying apparatus, for example, the difference between the ON-times of the threshold ON signal and the modulation signal does not cause a serious problem when the threshold light emission is made, as long as the difference only amounts to 1 dot or less. If the difference only amounts to 1 dot or less, the banding type noise appearing in the background portion of the paper that is subjected to the printing or copying may be tolerable or negligible from the practical point of view.

The red LD and the ultraviolet LD require more time until the carrier concentration sufficient to cause laser oscillation is generated, when compared to the infrared LD. Hence, depending on the type of the LD used, it may be desirable for the difference between the ON-times of the threshold ON signal and the modulation signal to be on the order of 10 ns in order to supply the threshold current approximately 10 ns before the modulation current. In addition, when forming the semiconductor laser driving unit in the form of the ASIC, the delay times may be set freely to cope with various types of LDs if the delay times are controllable from outside the ASIC semiconductor laser driving unit.

As described above, the initial ON modulation signal is turned ON for a short initial time period of 0.5 ns to 5 ns, for example, when the modulation signal turns ON. The short initial time period in which the initial ON modulation signal is turned ON may be set to improve the gradation representation, by taking into consideration the characteristic of the LD, and a characteristic of a photoconductive body in the case where the semiconductor laser driving unit 100 is used in the image forming apparatus such as the laser printer and the digital copying apparatus. In this case, the signal level of the initial ON modulation signal may be set to A times the signal level of the modulation signal by taking into consideration the characteristic of the LD and the characteristic of the photoconductive body, for example. Normally, the value A is on the order of 0.1 to 1. If the value A is greater than 1, the light emission quantity of the LD may exceed the rated value and damage the LD. Thus, the signal level of the initial ON modulation signal may be set to a level that does not deteriorate the serviceable life or the reliability of the LD.

FIG. 8 illustrates a modification of FIG. 7. In FIG. 8, the falling edge timing of the threshold ON signal is slightly delayed compared to the threshold ON signal illustrated in FIG. 7. The rising edge of the threshold ON signal in FIG. 8 occurs after the falling edge of the modulation signal. In other words, the threshold ON signal in FIG. 8 is turned OFF after confirming the OFF state of the modulation signal.

For example, it may be difficult to design a circuit that turns OFF both the modulation signal and the threshold ON signal exactly at the same timing. On the other hand, even if the threshold ON signal is turned OFF after confirming the OFF state of the modulation signal, the difference between the falling edges of the modulation signal and the threshold ON signal is only on the order of several ns at the most. If the difference between the falling edges is only on the order of several ns, the banding type noise appearing in the background portion of the paper that is subjected to the printing or copying may be tolerable or negligible from the practical point of view when the semiconductor laser driving unit 100 is used in the image forming apparatus such as the laser printer and the digital copying apparatus.

According to the circuit structure that enables the falling edge of the threshold ON signal to occur after the falling edge of the modulation signal, the threshold ON signal is prevented from turning OFF before the modulation signal turns OFF, and the semiconductor laser driving unit 100 may output accurate driving signals (or pulses).

Figure 9:
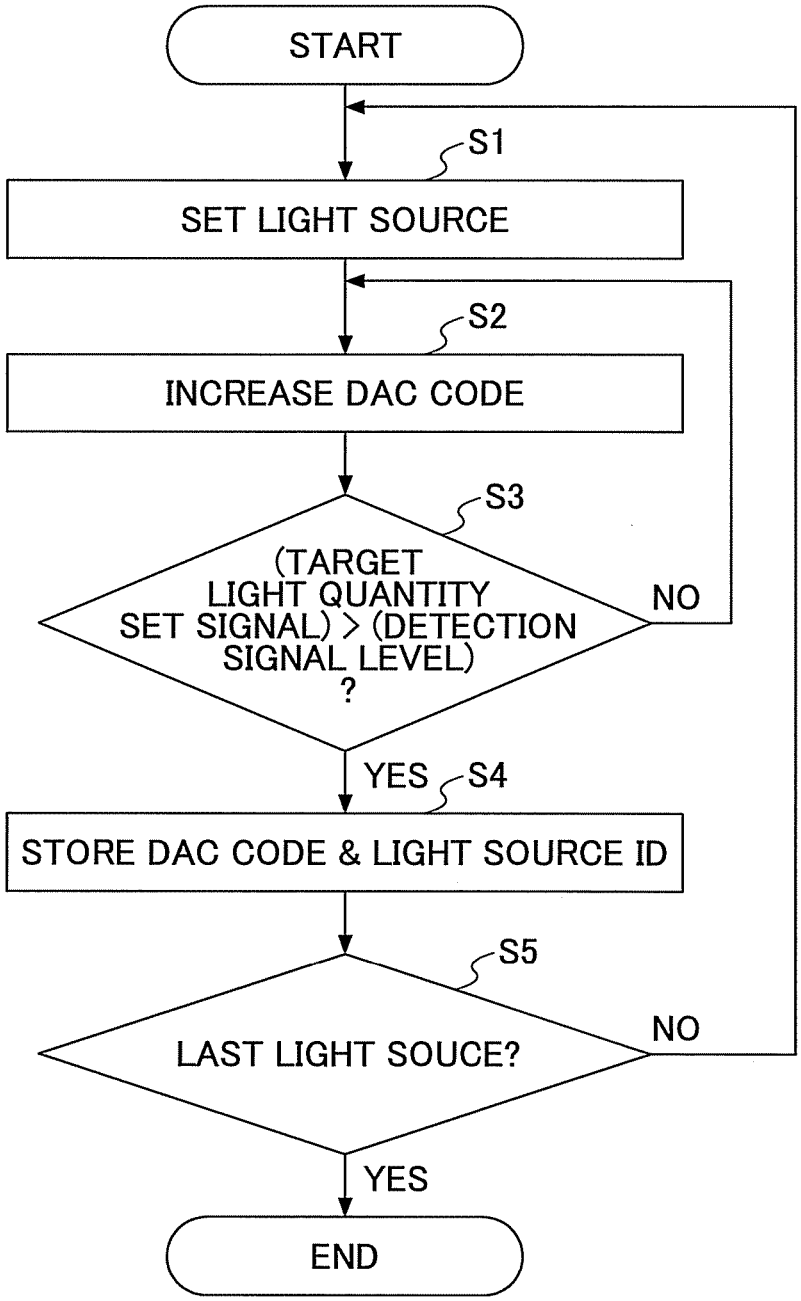
FIG. 9 is a flow chart for explaining a method of setting an overshoot current (or DAC codes) of the semiconductor laser driving unit in the embodiment.

Next, a description will be given of a method of setting the overshot current (or setting the DAC code) in the semiconductor laser driving unit 100 in the embodiment, by referring to FIG. 9. FIG. 9 is a flow chart for explaining the method of setting the overshoot current (or DAC codes) of the semiconductor laser driving unit in the embodiment. The process illustrated in FIG. 9 may be executed by the microcomputer 30 illustrated in FIG. 5.

The light emitted from the LD 1 is received and detected by the PD 2, and a PD current in accordance with the detected light quantity flows through the PD 2. The PD current is converted into a PD voltage by the resistor 16, and the PD voltage is integrated by the LPF 33 into a signal having a DC level. The integrated PD voltage (or DC level signal) from the LPF 33 is converted into a digital signal. The integration of the PD voltage by the LPF 33 corresponds to acquiring the integration value of the light quantity detected by the PD 2.

The semiconductor laser driving unit. 100 acquires the DAC codes for making the integration value of the light quantity obtained by the LPF 33 equal to the target value indicated by the target light quantity set signal or, for making the difference between the integration value of the light quantity obtained by the LPF 33 and the target value indicated by the target light quantity set signal fall within the predetermined range. The acquired DAC codes are stored in the memory 31, and used to drive the LD 1.

First, the microcomputer 30 carries out a setting with respect to the light source in a step S1. For example, if the semiconductor laser is formed by the LD array or the VCSEL, one of the light sources included in the LD array or the VCSEL is selected by the step S1. The process from the step S1 to a step S5 which will be described later may be repeated to carry out the process with respect to each of the light sources included in the LD array or the VCSEL.

The microcomputer 30 increases the DAC code in a step S2, in order to gradually increase the DAC code when the steps S1 through S5 are repeated. When the step S2 is carried out for the first time, the DAC code may be set to an initial value having a predetermined value.

The microcomputer 30 decides whether the level (or voltage) of the target light quantity set signal is greater than the level (or voltage) of the detection signal from the ADC 34, in a step S3. The process returns to the step S2 in order to increase the amount of the overshoot current by increasing the DAC code if the decision result in the step S3 is NO. On the other hand, if the decision result in the step S3 is YES, the microcomputer 30 stores the DAC code and the light source ID in the memory 31, in a step S4.

After the step S4, the microcomputer 30 decides whether the process with respect to the last light source has been carried out, in a step S5. The process returns to the step S1 if the decision result in the step S5 is NO, in order to switch the light source that is the DAC code adjusting target to a next light source. The DAC code adjusting process ends if the decision result in the step S5 is YES.

The step S3 may decide whether a difference between the level (or voltage) of the target light quantity set signal and the level (or voltage) of the detection signal from the ADC 34 is less than a predetermined value, instead of deciding whether the level (or voltage) of the target light quantity set signal is greater than the level (or voltage) of the detection signal from the ADC 34.

According to the semiconductor laser driving unit 100 in this embodiment, the set value of the DAC code may be increased in order to compensate for the insufficient light quantity caused by the delay or slow response of the driving signal waveform. In other words, by repeating the process of the steps S1 through S5 with respect to each of the plurality of light sources and storing the set value of the DAC code at the time when the decision result in the step S3 becomes YES, it becomes possible to generate an optical waveform with reduced delay and response for each of the light source.

The DAC code that is determined in the above described manner is adjusted so that the integrated value of the PD voltage becomes a predetermined value, in order to set an optimum overshoot current every time the semiconductor laser driving unit 100 is turned ON (or activated) or is released from a reset state. The overshoot current may be adjusted by the microcomputer 30 to the integration value of the light quantity and the optical waveform depending on the characteristic of the light sources.

In the example described above, the DAC code indicates the current value of the overshoot current. However, the DAC code may indicate a time (or additional time) for which the overshoot current is to be supplied. In this case, the current value of the overshoot current may be kept constant, and the additional time for which the overshoot current is to be supplied may be adjusted, in order to add the auxiliary value of the overshoot current to the modulation current. Alternatively, both the current value of the overshoot current and the additional time for which the overshoot current is to be supplied may be adjusted, in order to add the auxiliary value of the overshoot current to the modulation current.

Next, a description will be given of a method of setting the target integration value in the semiconductor laser driving unit in the embodiment. The target integration value indicates a target value of the light quantity to be integrated by the LPF 33.

Figure 10:
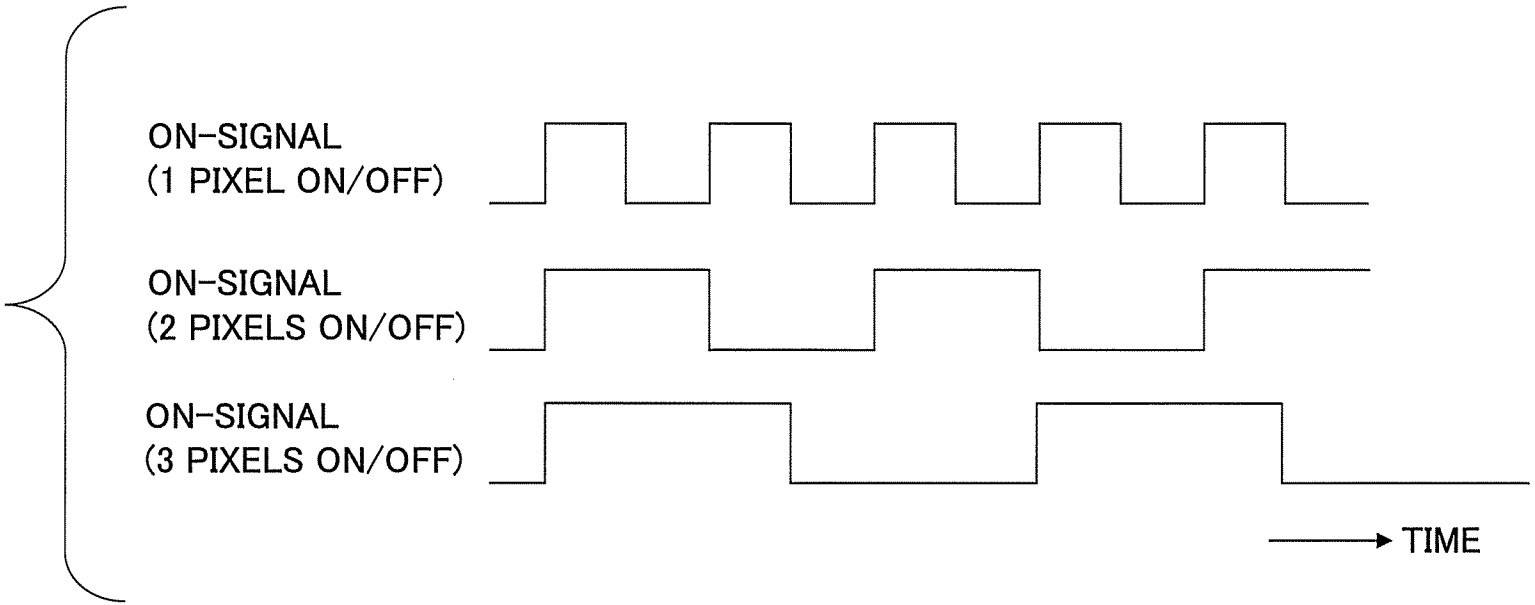
FIG. 10 is a timing chart for explaining ON-patterns of light sources when detecting an integration light quantity by the semiconductor laser driving unit in the embodiment.

FIG. 10 is a timing chart for explaining ON-patterns of the light sources when detecting the integration light quantity by the semiconductor laser driving unit in the embodiment.

The ON-patterns of the light sources when detecting the integration light quantity may be a repetition pattern in which the light source is turned ON and OFF in units of the period of a pixel clock that is in units of 1 pixel, for example. The ON-pattern of 1 pixel is repeated in the case of a 1 by 1 pattern, the ON-pattern of 2 pixels is repeated in the case of a 2 by 2 pattern, and the ON-pattern of 3 pixels is repeated in the case of a 3 by 3 pattern.

If the pixel clock has a frequency of 50 MHz, for example, the pixel clock period is 20 ns. In this case, the ON-pattern is a repetition of a 20 ns ON-time and a 20 ns OFF-time in the case of the 1 by 1 pattern, a repetition of a 40 ns ON-time and a 40 ns OFF-time in the case of the 2 by 2 pattern, and a repetition of a 60 ns ON-time and a 60 ns OFF-time in the case of the 3 by 3 pattern. Of course, the ON-time and the OFF-time of the pixels are not limited to the above, and may be set to arbitrary values.

Figure 11:
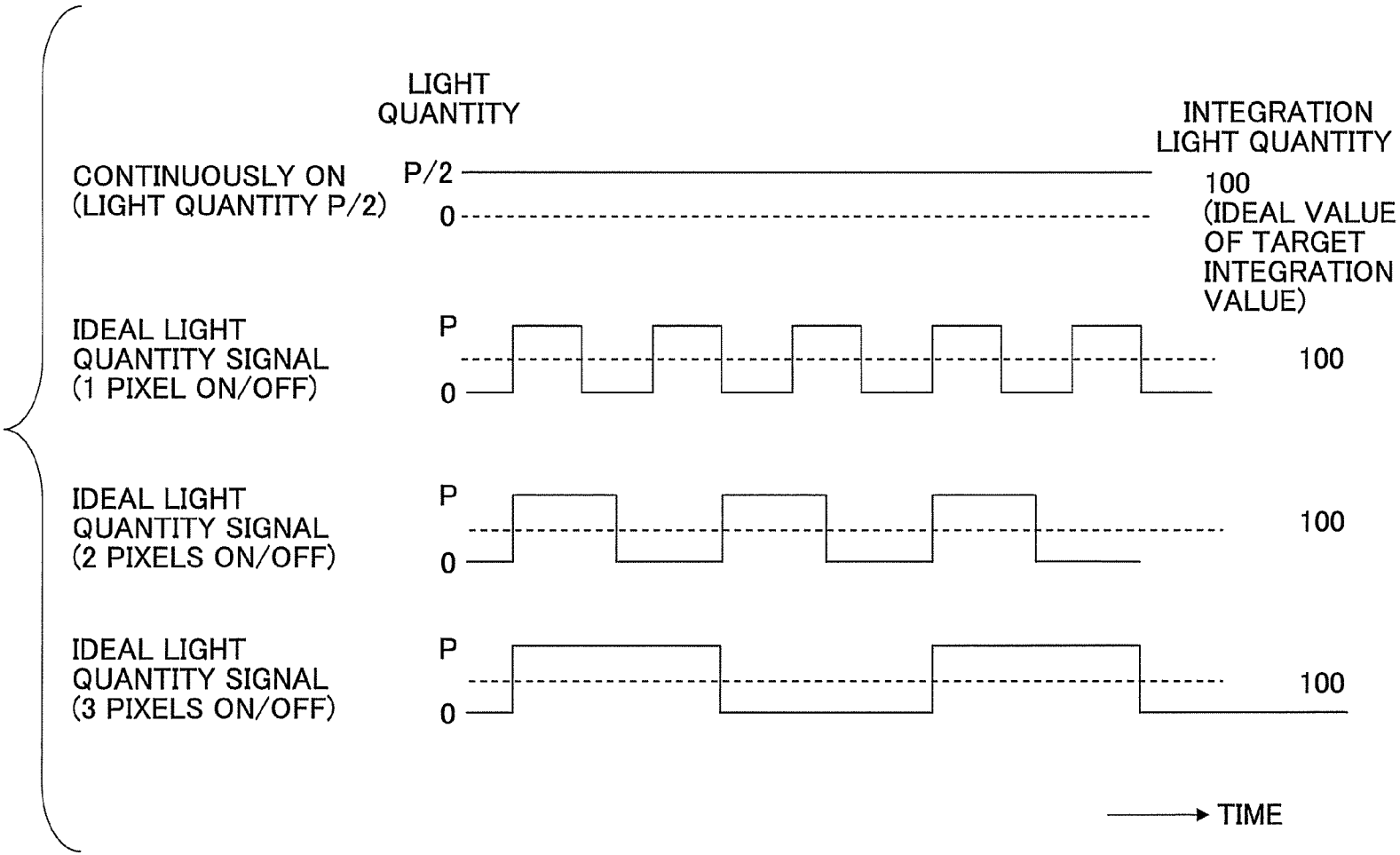
FIG. 11 is a timing chart for explaining a relationship between ON-patterns of the semiconductor laser driving unit and the integration light quantity in the embodiment.

FIG. 11 is a timing chart for explaining a relationship between the ON-patterns of the semiconductor laser driving unit and the integration light quantity in the embodiment. It is assumed for the sake of convenience that the LD 1 is an ideal LD driven by the 1 by 1 pattern in which the pixel is turned ON and OFF for each pixel unit at an ON light quantity level P. In this case, if the LD 1 turns ON and OFF by responding exactly according to the input signal, the integration light quantity becomes P/2 which is ½ the ON light quantity level when the light quantity signal, having the optical waveform in which the ON and OFF states of 1 pixel are repeated, is integrated. The same holds true when the LD 1 is driven by the 2 by 2 pattern, the 3 by 3 pattern, and the M by M pattern, where M is a natural number greater than 3.

If the integration light quantity is denoted by a value 100 for a case where the pixel is continuously ON at the ON light quantity level P/2, the integration light quantity has the value 100 in the case of the ideal LD in which the ON and OFF states are repeated at the same ratio and at the ON light quantity level P. However, in the actual LD, the integration light quantity has a value smaller than 100, due to the effects of the oscillation delay and the slow response of the optical waveform. This decrease in the integration light quantity causes the deterioration or inconsistency in the tone reproducible by the image forming apparatus that uses the semiconductor laser driving unit 100. For this reason, the microcomputer 300 of the semiconductor laser driving unit 100 in the embodiment sets the DAC code depending on the light emission of the LD 1 in accordance with a plurality of ON-patterns.

Figure 12A:
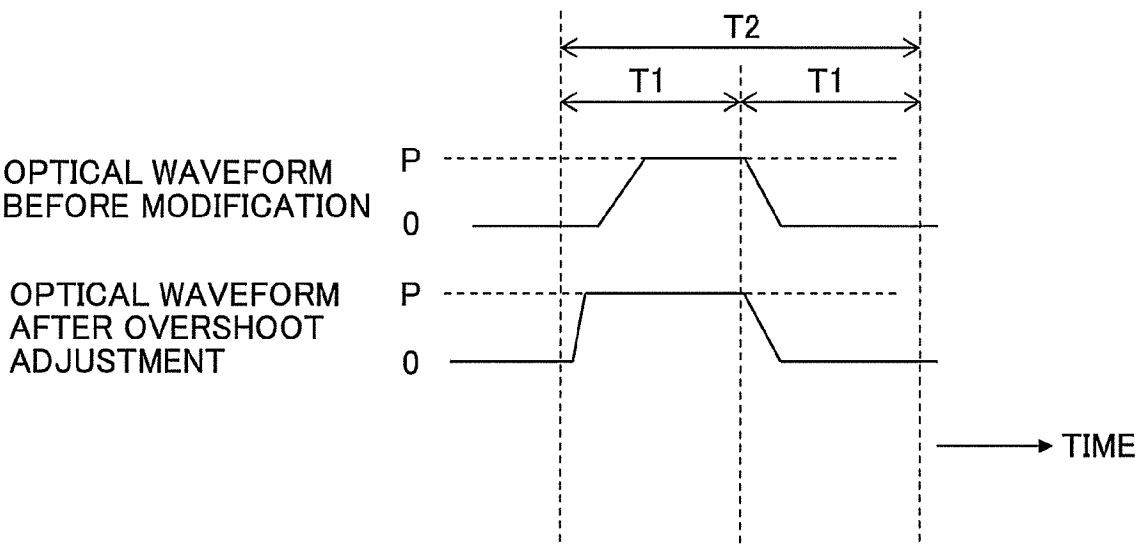
FIGS. 12A and 12B respectively are diagrams for explaining ON-patterns in which ON-times and OFF-times have the same time width for the semiconductor laser driving unit in the embodiment.
Figure 12B:
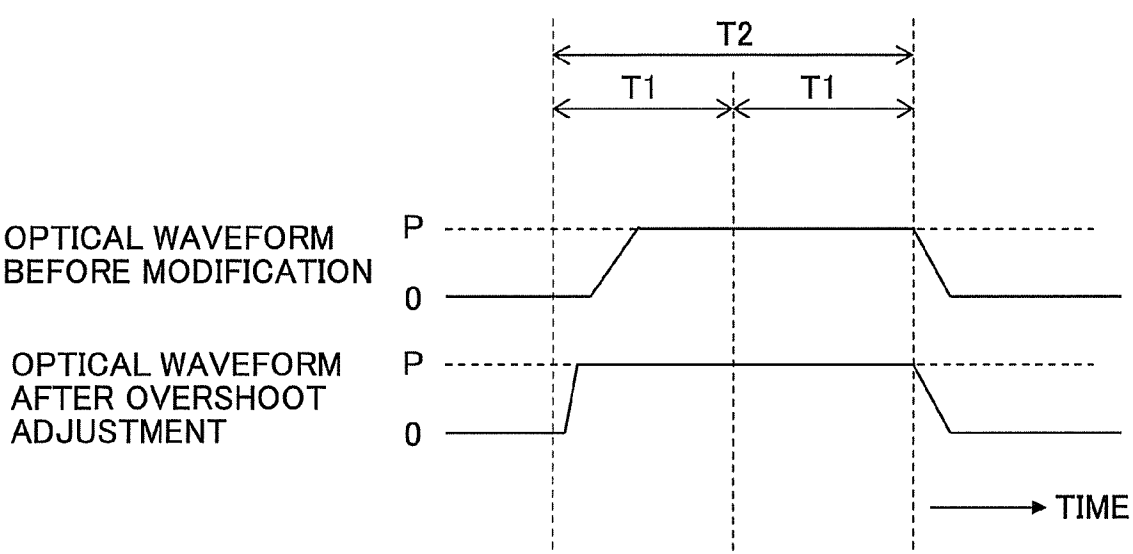

FIGS. 12A and 12B respectively are diagrams for explaining ON-patterns in which ON-times and OFF-times have the same time width for the semiconductor laser driving unit in the embodiment. In each of FIGS. 12A and 12B, the left portion illustrates a timing chart of the ON-pattern, and the right portion illustrates the target integration value. The ON-patterns illustrated in FIGS. 12A and 12B have mutually different ON-times.

In the ON-pattern illustrated in FIG. 12A, the ON-time has a width T1 and the OFF-time has the same width T1. When making the output current of the initial ON modulation current source 14 zero (0), that is, when the set value of the DAC code is zero (0) in order to set the overshoot current to zero (0), it is assumed for the sake of convenience that the integration light quantity becomes 50. In addition, when the set value of the DAC code for the initial ON modulation current source 14 is 20, it is assumed that the rising edge of the optical waveform will not include an overshoot with a relatively large peak with respect to the target integration value. In other words, it is assumed that the optical waveform becomes an optimum waveform with the integration light quantity of 80, as illustrated in FIG. 12A as the "optical waveform after overshoot adjustment", when compared to the "optical waveform before modification" that is not corrected (or modified) and the overshoot current is not applied. In addition, it is assumed that the target integration value after being corrected by the overshoot current output from the initial ON modulation current source 14 is set to 80.

When the process of the steps S2 and S3 is repeated to increase the DAC code, the overshoot current output from the initial ON modulation current source 14 gradually increases. Hence, when the microcomputer 30 judges the difference between the output signal of the ADC 34 and the target integration value in the step S3, the process of increasing the DAC code may be ended when the difference becomes zero (0) or the difference falls within the predetermined range. By storing in the memory 31 the DAC code at the time when the process of increasing the DAC code ends, the integration light quantity is finally adjusted to 80 in this example.

Even when the overshoot current is applied to the LD 1, the effects of the oscillation delay or the slow response in the optical waveform may still be observed when the ON-time described above is compared to the ideal ON-time. Although it may be difficult to actually obtain the ideal integration light quantity that is 100 and obtainable when the LD 1 emits the light quantity corresponding to the input pulse width, the target integration value in this example may be set to 80. In other words, the integration light quantity that is 80 is obtainable by setting the DAC code in the above described manner.

In the ON-pattern illustrated in FIG. 12B, the ON-time has a width T2 and the OFF-time has the same width T2. The width T2 is two times the width T1. Because the ON-time T2 is long compared to the ON-time T1, the integration light quantity for the ON-time T2 illustrated in FIG. 12B becomes a large value compared to that of the integration light quantity for the ON-time T1 illustrated in FIG. 12A. This is because the oscillation delay at the start of the ON-time T2 in FIG. 12B is similar to that at the start of the ON-time T1 in FIG. 12A, but the ON-time T2 in FIG. 12B is T1 longer than the ON-time T1 in FIG. 12A and the latter half (T1) of the ON-time T2 in FIG. 12B is continuously ON. Consequently, the latter half (T1) of the ON-time T2 in FIG. 12B contributes to the ideal integration light quantity.

Therefore, if the set value of the DAC code for the initial ON modulation current source 14 is the same for the case illustrated in FIG. 12A using the ON-time T1 and the case illustrated in FIG. 12B using the ON-time T2, the integration light quantity obtainable with the ideal optical waveform state is 92 for the case illustrated in FIG. 12B which is large compared to the integration light quantity of 80 that is obtainable for the case illustrated in FIG. 12A.

The integration light quantity is 80 for the case where no overshoot current is added, due to the effects of the oscillation delay. In addition, by adding the overshoot current in order to adjust the target integration value from 80 of the case illustrated in FIG. 12A to 92 of the case illustrated in FIG. 12B, it may be possible to obtain the integration light quantity that results in the light emission with a desired or ideal optical waveform.

It may be desirable for the target integration value to be 100 which is the identical integration light quantity. However, if the ON-time width is relatively short, the effects of insufficient light quantity integration caused by the oscillation delay with respect to the ON-time increases. For this reason, if the overshoot current is set in order to obtain the integration light quantity of 100, the rising edge of the optical waveform will have a large peak. In this case, if the ON-time is further extended in the case illustrated in FIG. 12B and the set value of the DAC code is the same as that for the case where the ON-time is relatively short, the integration light quantity increases for the case with the extended ON-time and may even exceed 100, as may be readily understood from the description of FIGS. 12A and 12B given above.

In other words, even if the target integration value is the same, the integration light quantity differs depending on the ON-time, and it may be necessary to adjust and set the set value of the DAC code depending on the ON-time.

The value of the integration light quantity does not necessarily have to be 100. For example, in order to balance edge parts of a line when rendering or plotting the line in the image forming apparatus, the set light quantity may be reduced in order not t excessively increase the overshoot current. In addition, if the response itself of the optical waveform has a tendency to include an overshoot, the integration light quantity may exceed 100 even before the correction is performed to add the overshoot current of the initial ON modulation current source 14. In such a case, an adjustment may be performed to reduce the integration light quantity. Moreover, in a case where the pixel width becomes insufficient due to narrowing of the pulse of the optical waveform, the target integration value may be adjusted and set to a value slightly larger than 100.

Therefore, the microcomputer 30 of the semiconductor laser driving unit 100 in the embodiment may set the DAC code depending on the light emission quantity of the LD 1 that is driven by the plurality of ON-patterns having different ON-times and OFF-times.

Figure 13A:
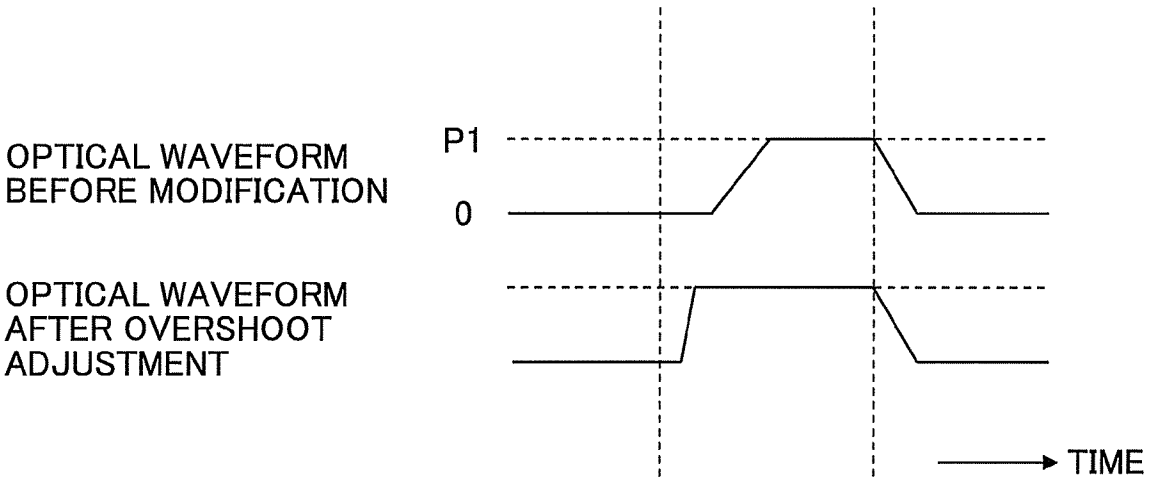
FIGS. 13A and 13B respectively are diagrams for explaining an optical waveform adjusting method of the semiconductor laser driving unit in the embodiment for a case where a changing quantity and a changing direction of a rising edge characteristic of the laser diode differ depending on a light quantity level.
Figure 13B:
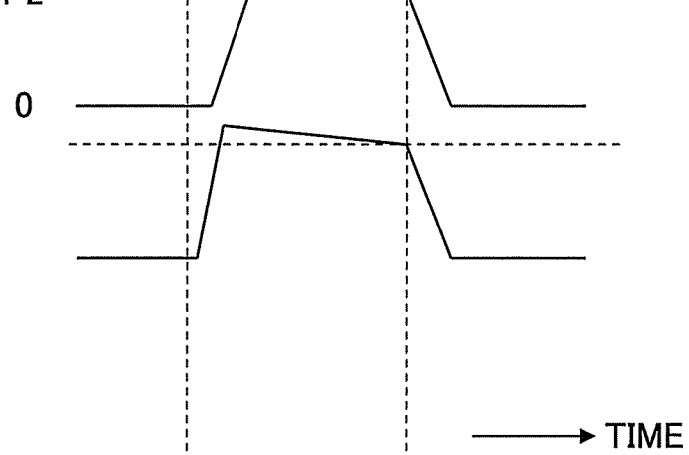

FIGS. 13A and 13B respectively are diagrams for explaining an optical waveform adjusting method of the semiconductor laser driving unit in the embodiment for a case where a changing quantity and a changing direction of a rising edge characteristic of the LD differ depending on the light quantity level. FIGS. 13A and 13B illustrate two cases where the ON light quantities P1 and P2 are different (P1<P2). It is assumed for the sake of convenience that the changing, quantity and the changing direction of the rising edge characteristic of the LD 1 differ depending on the light quantity level. In FIGS. 13A and 13B, those parts that are the same as those corresponding parts in FIGS. 12A and 12B are designated by the same reference numerals, and a description thereof will be omitted.

As illustrated in FIG. 13A, the oscillation delay and the slow response of the optical waveform at the rising edge of the optical waveform are larger than those in FIG. 13B. On the other hand, when the ON light quantity is increased to P2 as illustrated in FIG. 13B, the optical waveform at the rising edge thereof changes, and the oscillation delay decreases while an overshoot occurs instead of the slow response of the optical waveform.

It is assumed for the sake of convenience that, when the ON light quantity is P1, the integration light quantity is 50 for the optical waveform before the modification that applies the overshoot current, as illustrated in FIG. 13A. In this case, it is also assumed that the set value of the DAC code is 20 for obtaining the optimum overshoot current that includes no large peak at the rising edge of the optical waveform, and the integration light quantity is 80 due to the effects of the oscillation delay and the slow response of the optical waveform. Hence, in this case, the integration light quantity of 80 may be set as the target integration value in order to set the DAC code for the initial ON modulation current source 14. In this case, an ideal optical waveform having reduced oscillation delay and improved response of the optical waveform may be obtained by setting the integration light quantity of 80 as the target integration value and setting the DAC code of the initial ON modulation current source 14. FIG. 13A is basically the same as FIG. 12A described above.

On the other hand, it is assumed for the sake of convenience that, when the ON light quantity is P2 (P2>P1) as illustrated in FIG. 13B, the current supplied to the LD 1 is larger than that in FIG. 13A because of the larger ON light quantity P2. Hence, it is assumed that the integration light quantity is 80 for the optical waveform before the modification that applies the overshoot current, and this integration light quantity of 80 is large compared to that for the ON light quantity P1 which is 50. In addition, when the ON, light quantity is P2, the optical waveform includes an overshoot-like response characteristic with respect to the target integration value, and if the set value of the DAC code is 32, it is assumed that the integration light quantity is 88. In the case where the ON light quantity is P2, the target integration value may be set to the target integration value of 88, which is larger than the target integration value of 80 for the case where the ON light quantity is P1, and thus, the ideal optical waveform may be obtained.

When the correction that applies the overshoot current is performed in the case where the ON light quantity is P1 in order to set the target integration value to 100, the overshoot may be insufficient for the case where the same set value of the DAC code is used for the case where the ON light quantity is P2. In this case, the ideal optical waveform may not be obtained.

Accordingly, as may be seen by comparing the cases where the ON light quantities are P1 and P2, the optical waveform may become considerably different between the two cases if the correction using the same overshoot is made, depending on the ON light quantity used at the time of the image formation in the image forming apparatus. For this reason, the semiconductor laser driving unit 100 in the embodiment varies the target integration value depending on the ON light quantity, in order to perform an optimum correction of the optical waveform regardless of the ON light quantity. In addition, by setting the target integration value depending on the ON-time and the ON light quantity, an optimum correction of the optical waveform may be performed with respect to the light source whose characteristic may vary depending on the ON-time and the ON light quantity.

The setting of the DAC code described above may be made every time the light quantity is changed. The light quantity may be changed when the power of the semiconductor laser driving unit 100 is turned ON, when an initializing process of the semiconductor laser driving unit 100 is performed, between pages in the case of the image forming apparatus, between jobs of the apparatus using the semiconductor laser driving unit 100, when the apparatus using the semiconductor laser driving unit 100 resumes an operating mode from a standby mode, when adjusting the process control, when the ambient temperature of the LD 1 changes, and the like.

The optical waveform adjustment may be performed with respect to each light source, for all combinations of the light quantities and the pulse widths that may be used, in order to realize a highly accurate optical waveform correction and a highly accurate image formation in the case where the semiconductor laser driving unit 100 is used in the image forming apparatus. When performing the optical waveform adjustment, the selection of the ON-pattern (or light emission pattern) may differ depending on the image quality or the like required of the apparatus that uses the semiconductor laser driving unit 100.

For example, if the 1 by 1 patterns are aligned, the reproducibility of a 1-dot line improves, but the reproducibility of a 2-dot line becomes unstable compared to that of the 1-dot line. On the other hand, if the 2 by 2 patterns are aligned, the reproducibility of the 2-dot line improves, but the reproducibility of the 1-dot line becomes unstable compared to that of the 1-dot line.

Therefore, the patterns, such as the 1 by 1 patterns and the 2 by 2 patterns, may be selected depending on the required image quality, for example, in order to optimize the dot reproducibility. Hence, the microcomputer 30 of the semiconductor laser driving unit 100 in the embodiment may set the ON-pattern depending on the required image quality or the like.

Figure 14:
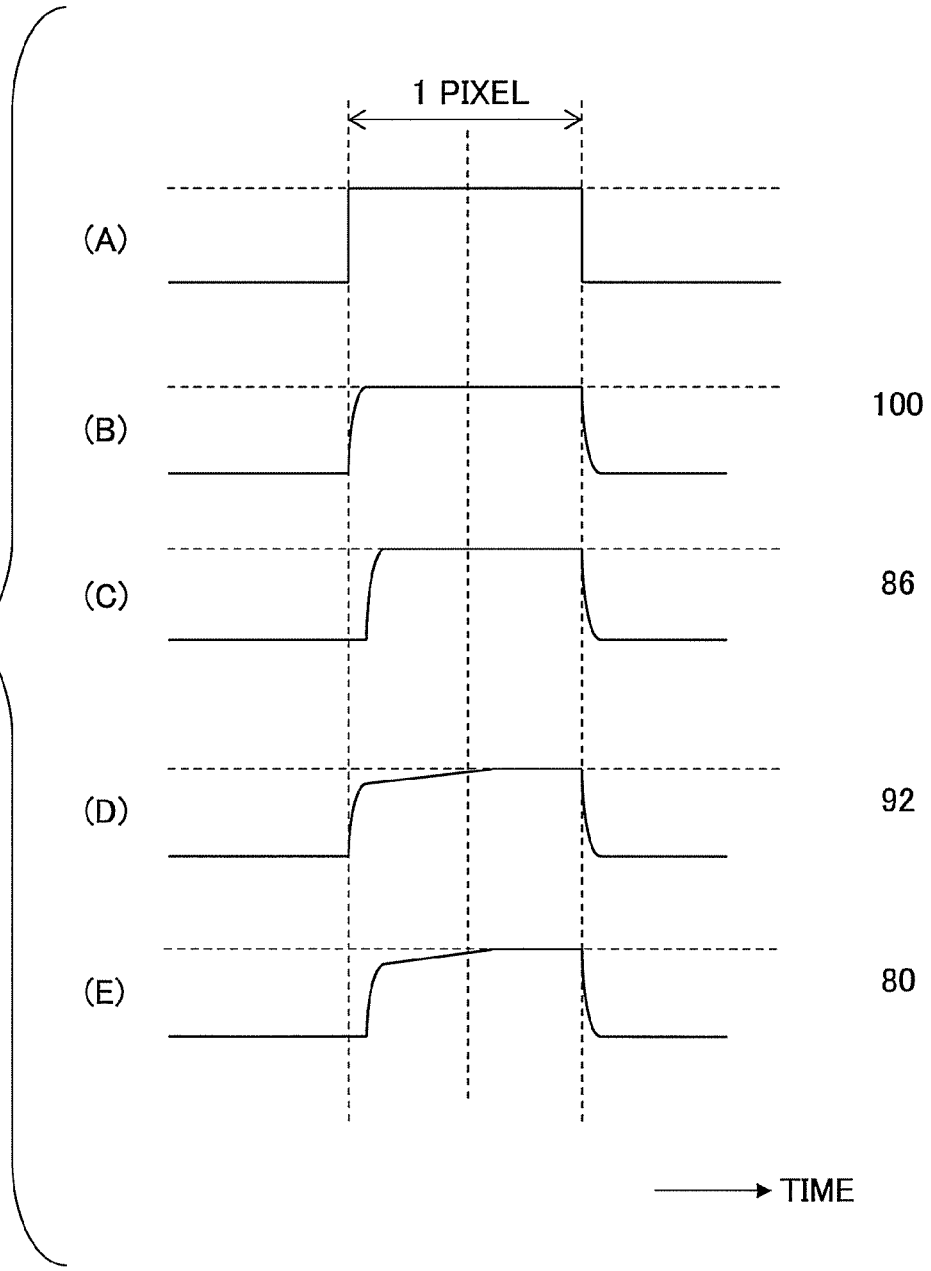
FIG. 14 is a timing chart for explaining optical outputs in response to input pulses of the semiconductor laser driving unit in the embodiment.

FIG. 14 is a timing chart for explaining optical outputs in response to input pulses of the semiconductor laser driving unit in the embodiment.

When adjusting the optical waveform, it may be necessary to change the target integration value of the integration light quantity depending on the extent of the narrowing of the pulse width of the optical waveform output from the light source, the extent of the slow response of the optical waveform, the ON-pattern, the pixel clock frequency, and the like. In this example, it is assumed for the sake of convenience that an input pulse illustrated in FIG. 14(A) is used as the light emission instruction signal.

For example, if the light source outputs an ideal optical waveform illustrated in FIG. 14(B), it is assumed for the sake of convenience that the target integration value for the case where this light source is turned ON by the 1 by 1 pattern is 100. The target integration value of 100 corresponds to a case where the optical waveform output from the light source in response to the input signal has an ideal rising edge characteristic that is sharp, including no narrowing of the pulse width and no slowing of the response.

On the other hand, in the case of an actual light source, an ideal optical waveform may not be obtained, and the optical waveform includes the narrowing of the pulse width and the slow response. In general, the integration light quantity decreases when compared to the ideal optical output.

For example, if the optical waveform includes narrowing of the pulse width as illustrated in FIG. 14(C), the integration light quantity decreases by an amount corresponding to a delay in the ON start time caused by the oscillation delay. In this case, the integration light quantity that is obtained is only 86 as compared to 100 for the ideal optical waveform.

If the optical waveform includes the slow response as illustrated in FIG. 14(D), the integration light quantity may become 92, for example, due to the slow response, particularly in a case where the light quantity gradually increases after the rising edge of the optical waveform.

Furthermore, the optical waveform output from the actual light source may include both the oscillation delay and the slow response as illustrated in FIG. 14(E). In this case, the integration light quantity may be 80, for example.

When a plurality of light sources are provided and the oscillation delay or the slow response of the optical waveform differs among the light sources, the light quantity output from the light sources may become inconsistent among the light sources. In this case, if the semiconductor laser driving unit 100 is used in the image forming apparatus, the tone of the image that is formed by the image formation may become unstable or inconsistent. Accordingly, in the case of the image forming apparatus, the adjustment of the integration light quantity by the applying of the overshoot current for each of the plurality of light source, and the reduction in the unstableness of the integration light quantity among the light sources, may effectively reduce the unstableness or inconsistency of the tone of the image that is formed by the image formation.

Next, a description will be given of the characteristic of the light source related to the semiconductor laser driving unit 100 in the embodiment.

For example, in a case where the light quantity is relatively small, the optical waveform may rise in several ns, and the light quantity may thereafter increase gradually in a time band of several tens of ns to several hundreds of ns. If a scan time amounting to 1 pixel in the image forming apparatus is 20 ns, for example, the integration light quantity has a tendency to increase as the number of pixels increases. As a result, the tone may increase between 1 pixel to approximately 16 pixels to cause the tone to become unstable or inconsistent.

On the other hand, in a case where the light quantity is relatively large, the optical waveform may rise in several ns, and the light quantity may thereafter decrease gradually in a time band of several tens of ns to several hundreds of ns. If the scan time amounting to 1 pixel in the image forming apparatus is 20 ns, for example, the integration light quantity has a tendency to decrease as the number of pixels increases. As a result, the tone may decrease between 1 pixel to approximately 16 pixels to also cause the tone to become unstable or inconsistent.

Of course, it is desirable that the light quantity is stable. However, if the light sources have different optical waveform response characteristics depending on the light quantity, it may be necessary to obtain an optimum current adjustment value for each light quantity.

FIG. 14 illustrates the case where 1 pixel is turned ON at a certain pixel clock frequency. However, if 1 pixel is turned ON at twice this pixel clock frequency, for example, the effect of the slow response of the optical waveform increases compared to the case illustrated in FIG. 14, and it may be regarded that the amount of current to be applied for the correction needs to be larger than that for the case illustrated in FIG. 14.

In addition, as illustrated in FIG. 11, when detecting the integration light quantity in 1-pixel unit, 2-pixel unit, 3-pixel unit, . . . , and M-pixel unit, the optimum amount of current to be applied for the correction differs for the different pixel unit sizes depending on the effects of the rising edge or the slow response of the optical waveform.

FIG. 15 is a diagram for explaining an example of a relationship of the ON-pattern, the target integration value, and the DAC code for the semiconductor laser driving unit in the embodiment. FIG. 15 illustrates a case where the integration light quantity is detected for the driving patterns in which the ON and OFF states are repeated in 1-pixel units (1 by 1 pattern), 2-pixel units (2 by 2 pattern), and 4-pixel units (4 by 4 pattern). The target integration value is either P1 or P2.

FIG. 15 illustrates the integration light quantity that is actually detected for each of the driving patterns, by regarding the integration light quantity as being 100 for the ideal optical waveform. The values in brackets indicate the set values of the corresponding DAC code.

For example, when the light quantity is P1, the set value of the DAC code differs depending on the ON-pattern. The set value of the DAC code is 16 for the 1 by 1 pattern, 14 for the 2 by 2 pattern, and 12 for the 4 by 4 pattern. The set value of the DAC code needs to be determined in order to perform the correction using the overshoot current, depending what the priority is form the image that is to be formed, for example.

If the balance of the entire image that is to be formed has a high priority, the set value of the DAC code may be an average value, 14 (={16+14+12}/3) of the 3 patterns. On the other hand, if the reproducibility of the 1-dot line has the high priority, the set value of the DAC code may be 16 for the 1 by 1 pattern. Furthermore, if the light quantity differs, the response characteristic of the optical waveform changes as may be seen from FIG. 15, and it may be regarded that the integration light quantity also changes. Hence, it may be desirable to set the DAG code to an optimum set value depending on the circumstances, such as the light quantity and the ON-pattern.

By varying the amount of correction of the LD driving current by the DAC code for each of the plurality of light sources depending on the response characteristic of the optical waveform, and correcting the response characteristic of each of the light sources, it becomes possible to achieve a balance among the plurality of light sources. That is, the inconsistency in the light emission among the plurality of light sources may be reduced. As a result, it may be possible to form a high-quality image when the semiconductor laser driving unit 100 is used in the image forming apparatus.

Therefore, the microcomputer 30 of the semiconductor laser driving unit 100 in the embodiment may set the ON-patterns of the plurality of light sources in order to reduce the inconsistency in the light emission among the plurality of light sources.

Next, a description will be given of the light emission characteristics obtained by the 1 by 1 pattern (turning ON 1-pixel units), the 2 by 2 pattern (turning ON 2-pixel units), and the 4 by 4 pattern (turning ON 4-pixel units), by referring to FIGS. 16, 17 and 18.

Figure 16:
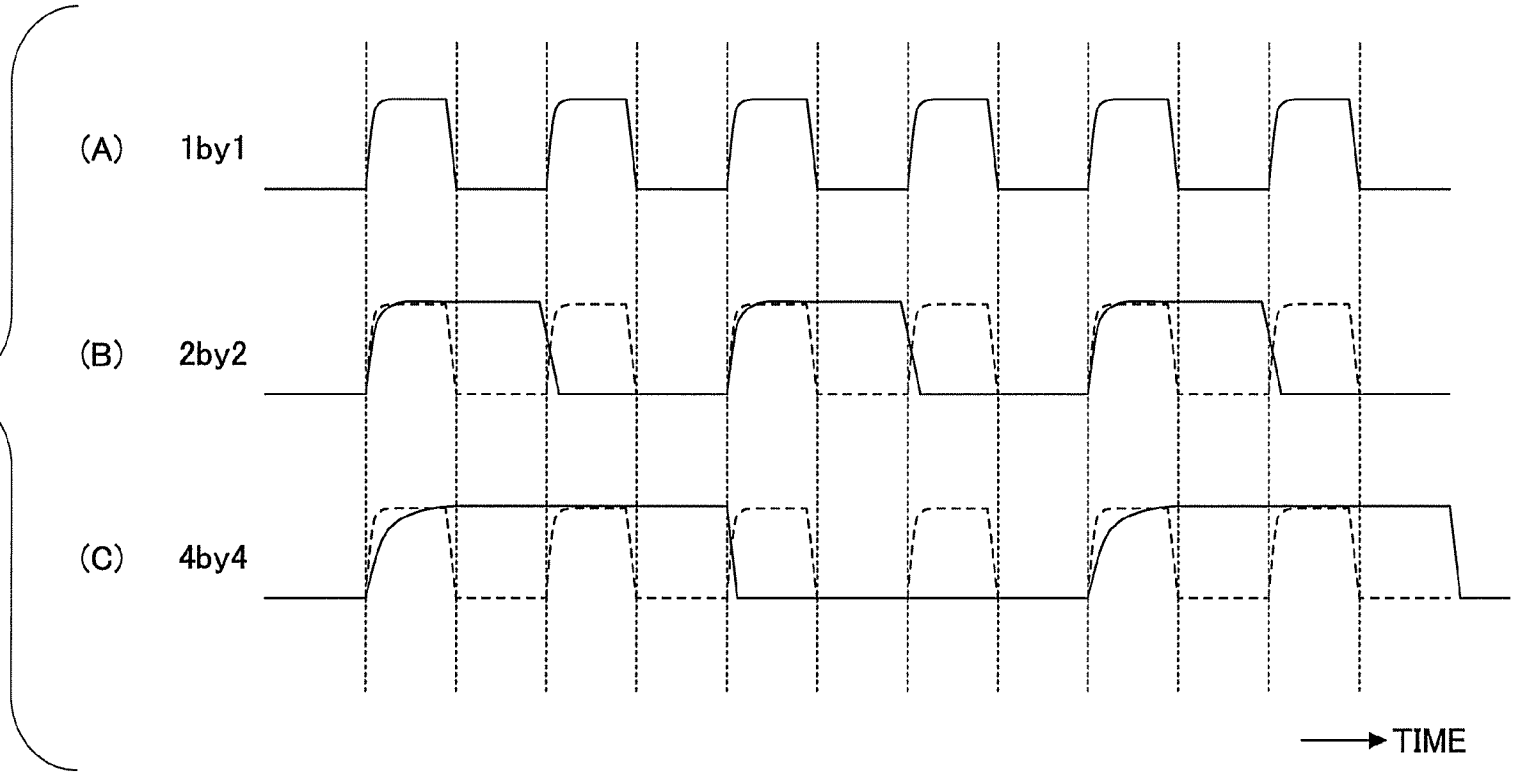
FIG. 16 is a timing chart for explaining light emission characteristics for a 1 by 1 pattern, a 2 by 2 pattern, and a 4 by 4 pattern.

FIG. 16 is a timing chart for explaining light emission characteristics for the 1 by 1 pattern, the 2 by 2 pattern, and the 4 by 4 pattern. FIG. 16(A) illustrates an optimized optical output obtained with the 1 by 1 pattern, FIG. 16(B) illustrates an optical output obtained with the 2 by 2 pattern using the setting of the overshoot current used by the 1 by 1 pattern to obtain the optical output illustrated in FIG. 16(A), and FIG. 16(C) illustrates an optical output obtained with the 4 by 4 pattern using the setting of the overshoot current used by the 1 by 1 pattern to obtain the optical output illustrated in FIG. 16(A). In FIGS. 16(B) and 16(C), a dotted line indicates, as a reference, the optical output obtained by the 1 by 1 pattern illustrated in FIG. 16(A).

The optimum optical output illustrated in FIG. 16(A) may be obtained by setting the target integration, value to 88 and the setting the set value of the DAC code to 12, for example. When the target integration value (88) and the set value (12) of the DAC code used with the 1 by 1 pattern to obtain the optimum optical output are used for the 2 by 2 pattern or the 4 by 4 pattern, the rising edge waveform has a tendency to become slower as the OFF time becomes longer, as may be seen from FIG. 16(B) or 16(C). This tendency is more conspicuous for the 4 by 4 pattern illustrated in FIG. 16(C) than for the 2 by 2 pattern illustrated in FIG. 16(B).

Accordingly, the optical output differs depending on whether the driving pattern is the 1 by 1 pattern, the 2 by 2 pattern, or the 4 by 4 pattern. In addition, the driving pattern optimized for the 1 by 1 pattern does not lead to an optimum optical output when used for other driving patterns, such as the 2 by 2 pattern and the 4 by 4 pattern.

Figure 17:
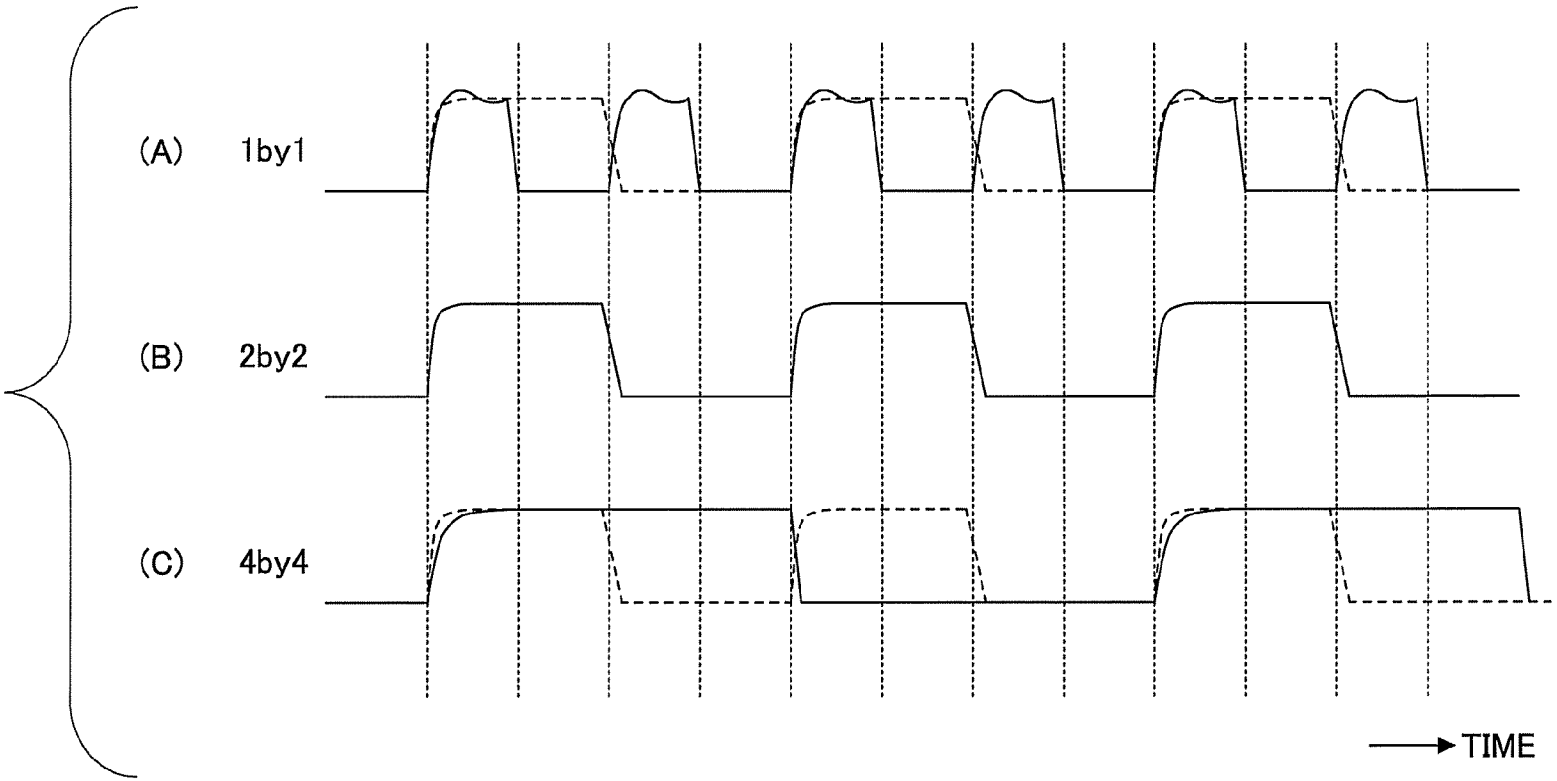
FIG. 17 is a timing chart for explaining the light emission characteristics for the 1 by 1 pattern, the 2 by 2 pattern, and the 4 by 4 pattern.

FIG. 17 is a timing chart for explaining the light emission characteristics for the 1 by 1 pattern, the 2 by 2 pattern, and the 4 by 4 pattern. FIG. 17(B) illustrates an optimized optical output obtained with the 2 by 2 pattern, FIG. 17(A) illustrates an optical output obtained with the 1 by 1 pattern using the setting of the overshoot current used by the 2 by 2 pattern to obtain the optical output illustrated in FIG. 17(B), and FIG. 17(C) illustrates an optical output obtained with the 4 by 4 pattern using the setting of the overshoot current used by the 2 by 2 pattern to obtain the optical output illustrated in FIG. 17(B). In FIGS. 17(A) and 16(C), a dotted line indicates, as a reference, the optical output obtained by the 2 by 2 pattern illustrated, in FIG. 17(B).

The optimum optical output illustrated in FIG. 17(B) may be obtained by setting the target integration value to 90 and the setting the set value of the DAC code to 14, for example. When the target integration value (90) and the set value (14) of the DAC code used with the 2 by 2 pattern to obtain the optimum optical output are used for the 1 by 1 pattern, an overshoot is generated at the rising edge of the optical waveform as illustrated in FIG. 17(A), and the tone at the start of the image formation may become dark. This overshoot at the rising edge of the optical waveform may be caused by the set value (14) of the DAC code that is larger than the set code (12) of the DAC code optimized for the 1 by 1 pattern illustrated in FIG. 16(A). On the other hand, when the target integration value (90) and the set value (14) of the DAC code used with the 2 by 2 pattern to obtain the optimum optical output are used for the 4 by 4 pattern, the rising edge waveform has a tendency to become slower as the OFF time becomes longer, as may be seen from FIG. 17(C).

Accordingly, the optical output differs depending on whether the driving pattern is the 1 by 1 pattern, the 2 by 2 pattern, or the 4 by 4 pattern. In addition, the driving pattern optimized for the 2 by 2 pattern does not lead to an optimum optical output when used for other driving patterns, such as the 1 by 1 pattern and the 4 by 4 pattern.

Figure 18:
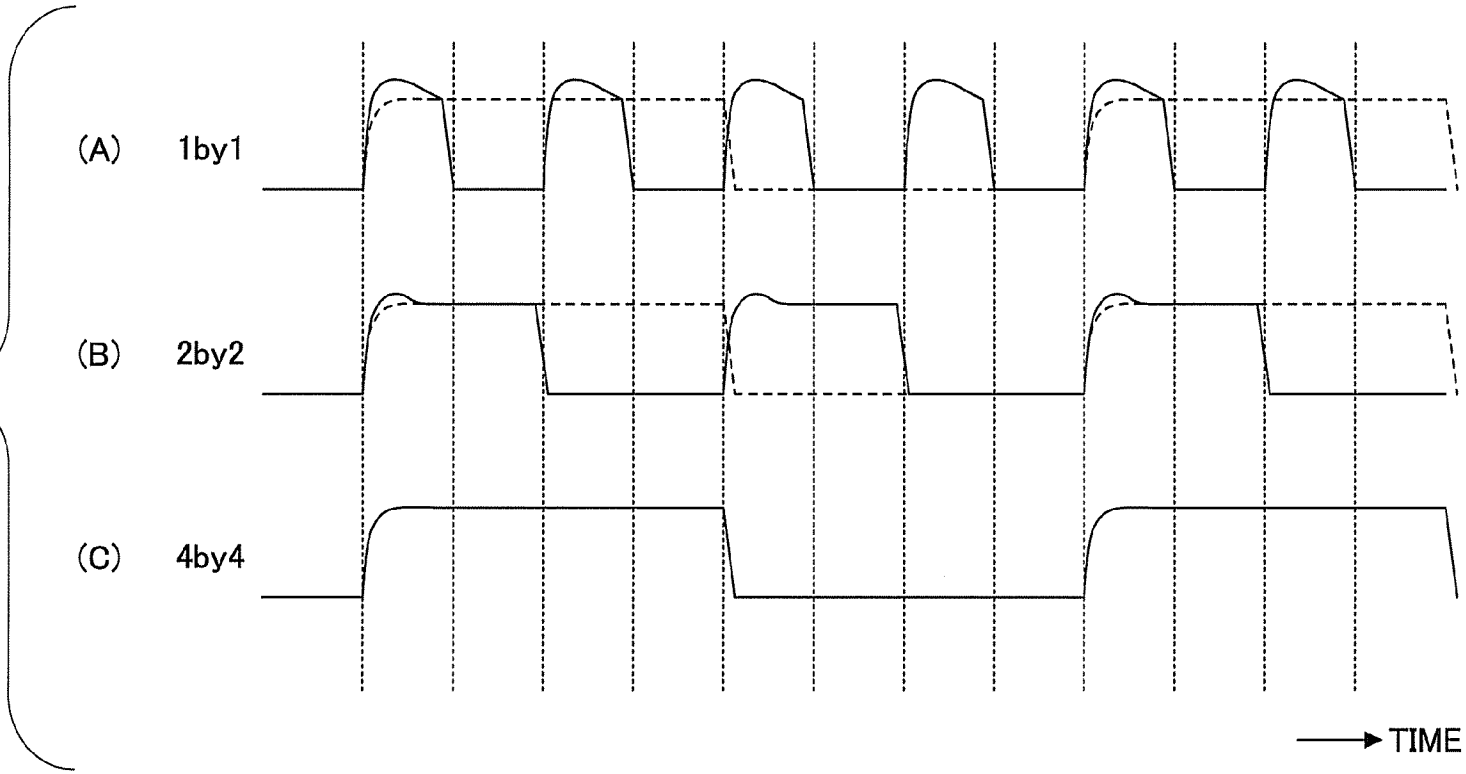
FIG. 18 is a timing chart for explaining the light emission characteristics for the 1 by 1 pattern, the 2 by 2 pattern, and the 4 by 4 pattern.

FIG. 18 is a timing chart for explaining the light emission characteristics for the 1 by 1 pattern, the 2 by 2 pattern, and the 4 by 4 pattern. FIG. 18(C) illustrates an optimized optical output obtained with the 4 by 4 pattern, FIG. 18(A) illustrates an optical output obtained with the 1 by 1 pattern using the setting of the overshoot current used by the 4 by 4 pattern to obtain the optical output illustrated in FIG. 18(C), and FIG. 18(B) illustrates an optical output obtained with the 2 by 2 pattern using the setting of the overshoot current used by the 4 by 4 pattern to obtain the optical output illustrated in FIG. 18(C). In FIGS. 18(A) and 18(B), a dotted line indicates, as a reference, the optical output obtained by the 4 by 4 pattern illustrated in FIG. 18(C).

The optimum optical output illustrated in FIG. 18(C) may be obtained by setting the target integration value to 92 and the setting the set value of the DAC code to 16, for example. When the target integration value (92) and the set value (16) of the DAC code used with the 4 by 4 pattern to obtain the optimum optical output are used for the 1 by 1 pattern, an overshoot is generated at the rising edge of the optical waveform as illustrated in FIG. 18(A), and the tone at the start of the image formation may become dark. This overshoot at the rising edge of the optical waveform may be caused by the set value (16) of the DAC code that is larger than the set code (12) of the DAC code optimized for the 1 by 1 pattern illustrated in FIG. 16(A). On the other hand, when the target integration value (92) and the set value (16) of the DAC code used with the 4 by 4 pattern to obtain the optimum optical output are used for the 2 by 2 pattern, an overshoot is generated at the rising edge of the optical waveform as illustrated in FIG. 18(B), and the tone at the start of the image formation may become dark. This overshoot at the rising edge of the optical waveform may be caused by the set value (16) of the DAC code that is larger than the set code (14) of the DAC code optimized for the 1 by 1 pattern illustrated in FIG. 17(B). The overshoot generated at the rising edge of the optical waveform has a tendency to become more conspicuous as the OFF time becomes shorter.

Accordingly, the optical output differs depending on whether the driving pattern is the 1 by 1 pattern, the 2 by 2 pattern, or the 4 by 4 pattern. In addition, the driving pattern optimized for the 4 by 4 pattern does not lead to an optimum optical output when used for other driving patterns, such as the 1 by 1 pattern and the 2 by 2 pattern.

Next, a description will be given of the optimization of the overshoot current, by referring to FIGS. 19 through 22.

Figure 19:
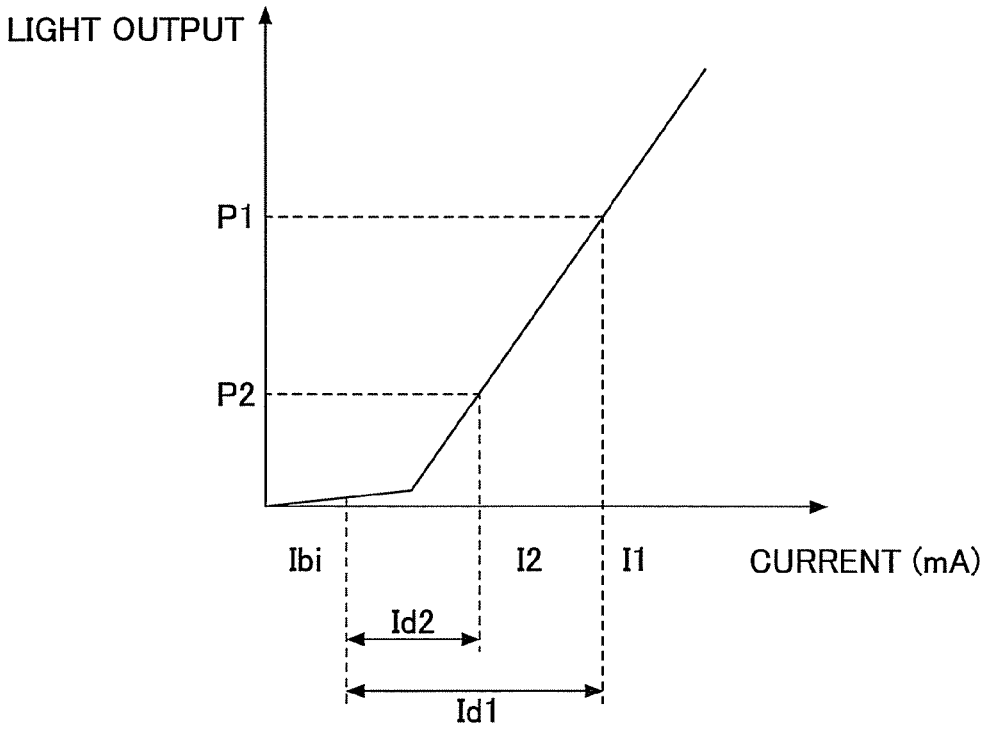
FIG. 19 is a diagram illustrating a relationship between a sum current applied to the laser diode and the optical output of the laser diode.

FIG. 19 is a diagram illustrating a relationship between a sum current applied to the LD and the optical output of the LD. A driving current I1 supplied to the LD 1 is a sum of a bias current Ibi and a sum current Id1, where the sum current Id1 is a sum of the threshold current and the modulation current. In addition, a driving current I2 supplied to the LD 1 is a sum of the bias current Ib1 and a sum current Id2, where the sum current Td2 is a sum of the threshold current and the modulation current. The current Id1 has a current value twice that of the current Id2.

When the bias current Ibi is supplied to the LD 1 as the driving current and the driving current is gradually increased, the rising edge of the optical output becomes sharp at a certain point, and the optical output P2 is obtained when the driving current becomes I2. In addition, when the driving current is further increased, the optical output P1 is obtained when the driving current becomes I1. As illustrated in FIG. 19, the optical output P1 is greater than the optical output P2.

When the rising edge response of the optical output is taken into consideration, the amount of current injected becomes larger for the case where the optical output P1 is obtained when compared to the case where the optical output P2 is obtained. For this reason, the rising edge response of the optical output is more satisfactory for the case where the optical output P1 is obtained, and the oscillation delay has a tendency of decreasing. In addition, the relationship between the current and the optical output deviates among the individual LDs, and each of the LDs has a slightly different characteristic. Hence, the slightly different characteristics of the LDs may cause inconsistencies in the rising edge characteristic of the optical waveform and the oscillation delay, depending on the LD that is used.

Figure 20:
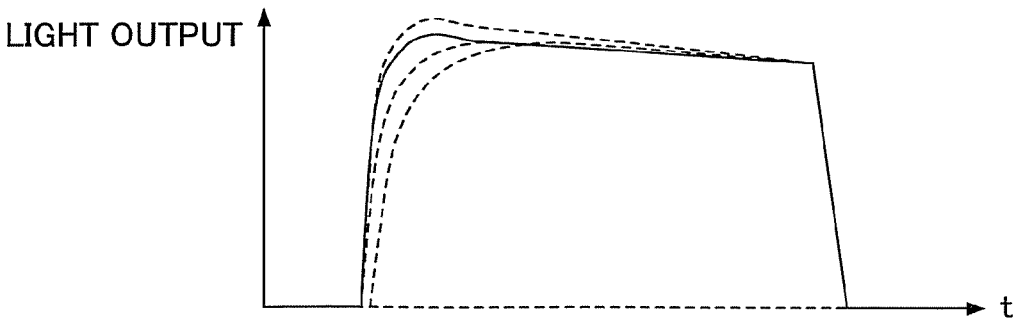
FIG. 20 is a diagram generally illustrating inconsistencies in a rising edge characteristic and an oscillation delay of the laser diode.
Figure 21:
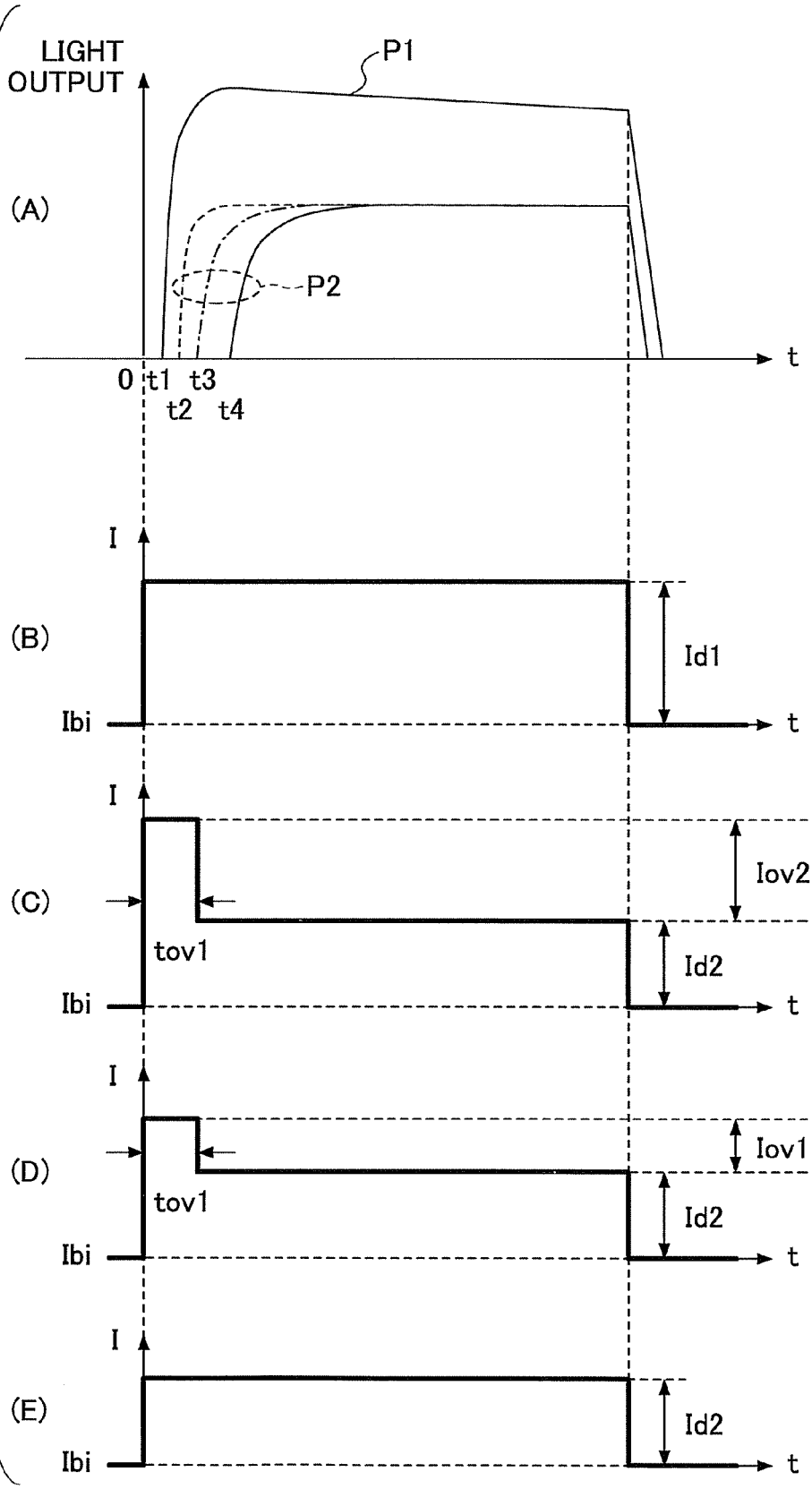
FIG. 21 is a timing chart illustrating a relationship between the current applied to the laser diode and the optical output of the laser diode.
Figure 22:
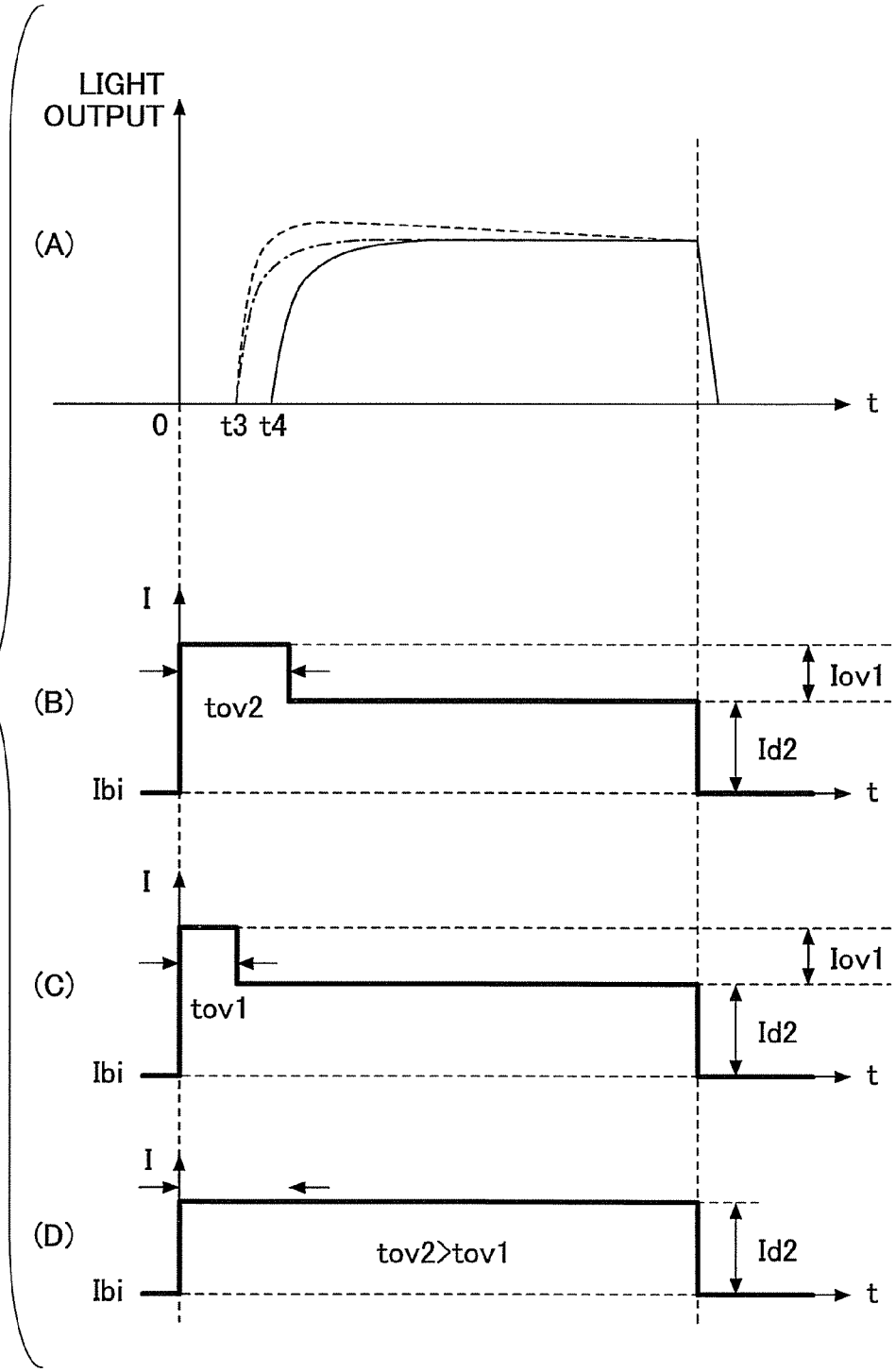
FIG. 22 is a timing chart for explaining a relationship between the current applied to the laser diode and the optical output of the laser diode when adjusting the overshoot current.

Next, a general description will be given of the rising edge characteristic and the oscillation delay of the LD, by referring to FIG. 20. FIG. 20 is a diagram generally illustrating inconsistencies in the rising edge characteristic and the oscillation delay of the LD. In FIG. 20 and FIGS. 21 and 22 which will be described later, the abscissa indicate the time "t" in arbitrary units.

In the semiconductor laser driving unit that drives the light sources, inconsistencies may be generated among a plurality of driving systems (or channels) that drive the light sources. Such inconsistencies may be caused by the inconsistency of the light source package itself, the inconsistency among the individual light sources, the inconsistency among the wirings on the circuit board on which the light sources and the wirings are provided, the inconsistency among the wirings connecting the circuit boards, and the inconsistency among the driving systems (or channels). These causes of the inconsistencies introduce inconsistencies in the optical output when the light sources are driven under the same condition, such as the inconsistencies in the rising edge characteristic and the oscillation delay of the light sources, as illustrated in FIG. 20. For example, even if the rising edge characteristic of the optical output is as indicated by a solid line in FIG. 20 for one light source (for example, LD), the rising edge characteristic of the optical output may be as indicated by one of three dotted lines for another light source (for example, LD).

FIG. 21 is a timing chart illustrating a relationship between the current applied to the LD and the optical output of the LD. FIG. 21(A) illustrates an optical output P1 and three optical outputs P2. The optical output P1 is greater than each of the optical outputs P2. In addition, of the three optical outputs P2 illustrated in FIG. 21(A), the optical output P2 indicated by a solid line corresponds to a case where the overshoot current set by the set value of the DAC code is zero (0). The optical output 22 indicated by a one-dot chain line corresponds to a case where the overshoot current set by the set value of the DAC code is Iov1 (>0), and the optical output P2 indicated by a dotted line corresponds to a case where the overshoot current set by the set value of the DAC code is Iov2 (>Iov1).

FIG. 21(B) illustrates a current Id1 required to obtain the optical output P1. The current Id1 is a sum of the threshold current output from the threshold current source 11 and the modulation current output from the modulation current source 13. The current Id1 is superimposed on the bias current Ibi output from the bias current source 12.

FIG. 21(E) illustrates a current Id2 required to obtain the optical output P2. The current Id2 is a sum of the threshold current output from the threshold current source 11 and the modulation current output from the modulation current source 13. The current values of the currents Id1 and Id2 may be adjusted by adjusting the currents output from the threshold current source 11 and the modulation current source 13. The comparator 15 may be used to adjust the threshold current output from the threshold current source 11. On the other hand, a comparator (not illustrated in FIG. 5), which compares the voltage across the terminals of the resistor 16 with a reference value, may be used to adjust the modulation current output from the modulation current source 13.

FIG. 21(C) illustrates the current Id2 required to obtain the optical output P2 indicated by the dotted line in FIG. 21(C) and an overshoot current Iov2. FIG. 21(D) illustrates the current Id1 required to obtain the optical output 22 indicated by the one-dot chain line in FIG. 21(C) and an overshoot current Iov1. The overshoot currents Iov1 and Iov2 both have the same pulse width tov1, however, the current value of the overshoot current Iov2 is larger than that of the overshoot current Iov1.

When the current Id1 illustrated in FIG. 21(B) is superimposed on the bias current Ibi and supplied to the LD 1, the optical output P1 illustrated in FIG. 21(A) is obtained. In addition, when the current Id2 illustrated in FIG. 21(E) is superimposed on the bias current Ibi and supplied to the LD 1, the optical output P2 illustrated in FIG. 21(A) is obtained. Because the current Id2 is smaller than the current Id1, the optical output 22 is lower than the optical output 21, as illustrated in FIG. 21(A).

The optical output 21 rises after a time t1 from a time 0 (or t0) when the current Id1 is applied to the LD 1. On the other hand, the optical output 22 rises after a time t4 from a time when the current Id2 is applied to the LD 1. In other words, the rising edge of the optical output P2 is delayed compared to that of the optical output P1. The rising edge of the optical output P2 is delayed compared to that of the optical output 21, because the amount of current injected to, the LD 1 is smaller for the current Id2 than for the current Id1, thereby causing a delay in the oscillation response of the LP 1. Hence, in a case where the sum of the threshold current and the modulation current is relatively small, as in the case of the current Id2, it may be effective from the point of view of reducing the oscillation delay to further add the overshoot current.

In a case where the overshoot current Iov2 is added to the current Id2 as illustrated in FIG. 21(C), for example, the optical output P2 indicated by the dotted line in FIG. 21(A) is obtained. The optical output P2 indicated by the dotted line has a rising edge after a time t2 elapses from the time 0 (or t0) when the current Id2 and the overshoot current Iov2 are supplied to the LD 1. In addition, the optical output 22 indicated by the dotted line, after rising, has the same level as the optical output P2 indicated by the solid line in FIG. 21(A). In other words, by adding the overshoot current Iov2 having a narrow pulse width (tov1) to the current Id2 when the LD 1 oscillates, the oscillation delay of the optical output of the LD 1 may be reduced.

On the other hand, in a case where the overshoot current Iov1 is added to the current Id2 as illustrated in FIG. 21(D), the optical output P2 indicated by the one-dot chain line in FIG. 21(A) is obtained. The optical output P2 indicated by the one-dot chain line has a rising edge after a time t3 elapses from the time 0 (or t0) when the current Id2 and the overshoot current Iov1 are supplied to the LD 1. In addition, the optical output P2 indicated by the one-dot chain line, after rising, has the same level as the optical output P2 indicated by the solid line in FIG. 21(A).

The rising edge of the optical output P2 indicated by the one-dot chain line is delayed compared to the rising edge of the optical output P2 indicated by the dotted line, because the overshoot current Iov1 for obtaining the optical output P2 indicated by the one-dot chain line is smaller than the overshoot current Iov2 for obtaining the optical output 22 indicated by the dotted line.

By adjusting the sum of the threshold current and the modulation current, as in the case of the currents Id1 and Id2 described above, the optical output may be adjusted. Moreover, the delay time in the rising edge of the optical output of the LD 1 may be shorter if the sum of the threshold current and the modulation current is larger, and may be longer if the sum of the threshold current and the modulation current is smaller. Furthermore, it may be seen that the timing of the rising edge of the optical output of the LD 1 is adjustable by adjusting the current value of the overshoot current.

Next, a description will be given of a case where the pulse width of the overshoot current is adjusted, by referring to FIG. 22. FIG. 22 is a timing chart for explaining a relationship between the current applied to the LD and the optical output of the LD when adjusting the overshoot current.

FIG. 22(A) illustrates three optical outputs P2. As in the case of the optical outputs P2 illustrated in FIG. 21(A), the three optical outputs P2 illustrated in FIG. 22(A) are obtained by a current Id2 that is a sum of the threshold current output from the threshold current source 11 and the modulation current output from the modulation current source 13. The optical output P2 indicated by a solid line corresponds to a case where the overshoot current set by the set value of the DAC code is zero (0). The optical output P2 indicated by a one-dot chain line corresponds to a case where the overshoot current set by the set value of the DAC code is Iov1 (>0), and a pulse width of the overshoot current is set to tov2. The optical output P2 indicated by a dotted line corresponds to a case where the overshoot current set by the set value of the DAC code is Iov2 (>Iov1), and a pulse width of the overshoot current is set to tov1 (<tov2).

FIG. 22(D) illustrates a current Id2 required to obtain the optical output P2. The current Id2 is a sum of the threshold current output from the threshold current source 11 and the modulation current output from the modulation current source 13.

FIG. 22(B) illustrates the current Id2 required to obtain the optical output P2 indicated by the dotted line in FIG. 22(A) and the overshoot current Iov1 having the pulse width tov2. FIG. 22(C) illustrates the current Id2 required to obtain the optical output P2 indicated by the one-dot chain line in FIG. 22(A) and the overshoot current Iov1 having the pulse width tov1. The pulse width tov1 is the same as the pulse width tov2 illustrated in FIGS. 21(C) and 21(D). The pulse width tov2 of the overshoot current Iov1 is approximately twice as long as the pulse width tov1, for example.

When the current Id2 illustrated in FIG. 22(D) is superimposed on the bias current Ibi and supplied to the LD 1, the optical output P2 indicated by the solid line in FIG. 22(A) is obtained. The optical output P2 rises after a time t4 from a time 0 (or t0) when the current Id2 is applied to the LD 1. The time t4 is the same as the time t4 illustrated in FIG. 21(A).

As illustrated in FIG. 22(B), when the overshoot current Iov2 having the pulse width tov2 is added to the current Id2, the optical output P2 indicated by the dotted line in FIG. 22(A) is obtained. The optical output P2 indicated by the dotted line has a rising edge, after a time t3 elapses from the time 0 (or t0) when the current Id2 and the overshoot current Iov2 are supplied to the LD 1. In addition, the optical output P2 indicated by the dotted line, after rising, has the same level as the optical output P2 indicated by the solid line in FIG. 22(A). In other words, by adding the overshoot current Iov2 having the narrow pulse width (tov1) to the current Id2 when the LD 1 oscillates, the oscillation delay of the optical output of the LD 1 may be reduced.

On the other hand, in a case where the overshoot current Iov1 is added to the current Id2 as illustrated in FIG. 22(C), the optical output P2 indicated by the one-dot chain line in FIG. 22(A) is obtained. The optical output P2 indicated by the one-dot chain line has a rising edge after the time t3 elapses from the time 0 (or t0) when the current Id2 and the overshoot current Iov1 are supplied to the LD 1. In addition, the optical output P2 indicated by the one-dot chain line, after rising, has the same level as the optical output P2 indicated by the solid line in FIG. 22(A).

The rising edge of the optical output 22 indicated by the one-dot chain line and the rising edge of the optical output 22 indicated by the dotted line in FIG. 22(A) both occur at the same time t3. This is because the current Id added with the overshoot current Iov1 is supplied to the LD 1, and the amount of current injected to the LD 1 is the same for both cases where the optical outputs P2 indicated by the one-dot chain line and the dotted line are obtained. After the optical output P2 rises at the time t3, the manner in which the rising edge rises differs between the optical outputs 22 indicated by the one-dot chain line and the dotted line. This is because the pulse width tov2 of the overshoot current Iov1 used to obtain the optical output P2 indicated by the dotted line is wider than the pulse width tov1 of the overshoot current Iov1 used to obtain the optical output P2 indicated by the one-dot chain line.

Therefore, when the current value of the sum of the threshold current and the modulation current supplied to the LD 1 is the same, and the current value of the overshoot current additionally supplied to the LD 1 is the same, the wider the pulse width of the overshoot current the sharper the rising edge of the optical output of the LD 1, and the narrower the pulse width of the overshoot current the more gradual (or slow response) the rising edge of the optical output of the LD 1.

As may be seen from FIGS. 2.1 and 22, the rising edge of the optical output of the LD 1 and the manner in which the rising edge of the optical output occurs (for example, whether the rising edge of the optical output is sharp) may be determined from any one of the current value of the sum of the threshold current output from the threshold current source 11 and the modulation current output from the modulation current source 13, the current value of the overshoot current additionally applied to the LD 1, and the pulse width of the overshoot current additionally applied to the LD 1. For this reason, by setting the driving current of the LD 1 depending on the light emission state of the light source, by adjusting the current value of the sum of the threshold current output from the threshold current source 11 and the modulation current output from the modulation current source 13, the current value of the overshoot current additionally applied to the LD 1, and the pulse width of the overshoot current additionally applied to the LD 1, it maybe possible to improve the optical waveform output from the LD 1 by reducing at least one of the narrowing of the pulse width of the optical waveform and the slow response of the optical waveform. Consequently, the inconsistencies in the light quantities output from the light sources may be reduced, and a high-speed high-precision rendering or plotting of the image may be performed to obtain a satisfactory gradation representation (or reproducibility) even at the relatively low tone when the semiconductor laser driving unit 100 is applied to the image forming apparatus.

For example, when a plurality of light emission patterns, such as the 1 by 1 pattern, the 2 by 2 pattern, and the 4 by 4 pattern, exist, the current value or the pulse width of the overshoot current may be set depending on the light emission of the LD 1 responsive to the plurality of light emission patterns.

In addition, when a plurality of light emission patterns, such as the 1 by 1 pattern, the 2 by 2 pattern, and the 4 by 4 pattern, exist, and the image quality to be rendered or plotted differs depending on the light emission pattern, for example, the light emission pattern may be set depending on the image quality to be obtained by the light emission of the LD 1.

In a case where the LDs 1 are arranged in an array and the array is used to render or plot the image in the image forming apparatus and a relatively large inconsistency exists among the light emissions from the LDs 1, the light emission patterns of the LDs 1 may be set in order to reduce the inconsistency among the light emissions from the LDs 1.

In addition, because the rising edge characteristic or the response characteristic of the optical output of the LD 1 varies depending on the pulse width of the overshoot current, the pulse width of the overshoot current or the time for which the overshoot current is added to the driving current may be set depending on the clock frequency that is used when generating the pixels of the image.

The pulse width of the overshoot current or the time for which the overshoot current is added to the driving current may be set depending on the difference between the light emission from the LD 1 detected by the PD 1 and the target light emission from the LD 1.

The pulse width of the overshoot current or the time for which the overshoot current is added to the driving current may be set depending on the inconsistencies among the light emissions of each of the individual LDs 1.

According to the embodiment described above, it is possible to provide a laser driving unit and an image forming apparatus including such a laser driving unit, which may obtain from the light source an optical output having rectangular waveform and a pulse width satisfactorily reproducing an input signal, by adjusting the amount of overshoot current added to the driving signal that drives the light source. In addition, when performing the image formation using the laser driving unit, the integration light quantity may be optimized and stabilized using the overshoot current.

Figure 23:
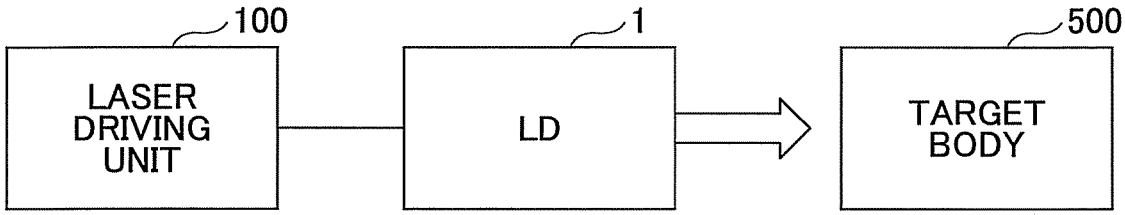
FIG. 23 is a block diagram for explaining an example of an apparatus including the laser driving unit.

Next, a description will be given of the apparatus using the laser driving unit described above. FIG. 23 is a block diagram for explaining an example of an apparatus including the semiconductor laser driving unit 100. In FIG. 23, those parts that are the same as those corresponding parts in FIG. 5 are designated by the same reference numerals, and a description thereof will be omitted. The apparatus illustrated in FIG. 23 may be any one of an image forming apparatus, an optical disk drive, and an optical communication apparatus.

In the case of the image forming apparatus, such as the laser printer and the digital copying apparatus, a target body 500 is formed by a photoconductive body, such as a photoconductive drum. The laser beam emitted from the LD 1 scans a charged surface of the target body 500 by a known method to form an electrostatic latent image, and this electrostatic latent image is formed into a visible toner image by a, known method. The toner image is then transferred onto a recording medium, such as paper, by a known method. Such an image forming apparatus employing the electrophotography technique is known, and a detailed description thereof will be omitted.

In the case of the optical disk drive, the target body 500 is formed by an optical disk. The laser beam emitted from the LD 1 scans a surface of the target body 500 by a known method. The laser beam may write information on the target body 500 by a known method or, read information recorded on the target body 500 from the laser beam reflected from the surface of the target body by a known method. Such an optical disk drive is known, and a detailed description thereof will be omitted.

In the case of the optical communication apparatus, the target body 500 may include an optical system, an optical fiber, an optical isolator, and the like. The laser beam emitted from the LD 1 is amplified within the target body 500 and the amplified optical signal is transmitted to a communication channel formed by an optical fiber cable, for example. Such an optical communication apparatus is known, and a detailed description thereof will be omitted.

Further, the present invention is not limited to these embodiments, but various variations and modifications may be made without departing from the scope of the present invention.

What is claimed is:

1. A laser driving unit configured to drive a semiconductor laser apparatus including a plurality of light sources, comprising:

a light detecting unit configured to detect light emissions from the plurality of light sources;

a bias current generator configured to generate a bias current lower than or equal to a threshold current of the plurality of light sources;

a modulation current generator configured to generate a modulation current, to cause light emission of the plurality of light sources, depending on a modulation signal;

an auxiliary driving current generator configured to generate an auxiliary driving current to assist the modulation current during an initial time period of an ON-time of the modulation current, wherein a driving current to drive each of the plurality of light sources includes the bias current, the modulation current, and the auxiliary driving current; and an auxiliary current set unit configured to set an auxiliary amount of the auxiliary driving current to be added to the modulation current, for each of the plurality of light sources, based on a difference between a target light emission of the plurality of light sources and the light emission detected by the light detecting unit when the plurality of light sources are driven by the driving current.

2. The laser driving unit as claimed in claim 1, further comprising:

a storage unit configured to store the auxiliary amount set by the auxiliary current set unit, wherein the auxiliary current generator generates the auxiliary driving current to be added to the modulation current based on the auxiliary amount stored in the storage unit.

3. The laser driving unit as claimed in claim 1, wherein the auxiliary current set unit sets the auxiliary amount by varying the target light emission for each of a plurality of ON-patterns of the plurality of light sources.

4. The laser driving unit as claimed in claim 1, wherein the auxiliary current set unit sets the auxiliary amount depending on the light emissions of the plurality of light sources in response to a plurality of light emission patterns of the plurality of light sources.

5. The laser driving unit as claimed in claim 4, wherein the auxiliary current set unit sets the light emission pattern depending on an image quality to be obtained by an image formation using the light emissions from the plurality of light sources.

6. The laser driving unit as claimed in claim 1, wherein the auxiliary current set unit sets a light emission pattern of the plurality of light sources in order to reduce inconsistencies in light emission among the plurality of light sources.

7. The laser driving unit as claimed in claim 1, wherein the auxiliary current set unit sets the auxiliary amount depending on a clock frequency for generating pixels of an image to be formed by an image formation using the light emissions from the plurality of light sources.

8. The laser driving unit as claimed in claim 1, wherein the auxiliary current set unit sets a current value of the auxiliary amount of the auxiliary driving current to be added to the modulation current, for each of the plurality of light sources, based on the difference between the light emission detected by the light detecting unit and the target light emission of the plurality of light sources, and the auxiliary driving current generator generates the auxiliary driving current having the current value set by the auxiliary current set unit.

9. The laser driving unit as claimed in claim 1, wherein the auxiliary current set unit sets a time for which the auxiliary driving current is to be added to the modulation current, for each of the plurality of light sources, based on the difference between the light emission detected by the light detecting unit and the target light emission of the plurality of light sources, and the auxiliary driving current generator generates the auxiliary driving current for the time set by the auxiliary current set unit.

10. The laser driving unit as claimed in claim 9, wherein auxiliary current set unit sets the time depending on characteristics of the plurality of light sources.

11. The laser driving unit as claimed in claim 1, wherein the plurality of light sources of the semiconductor laser apparatus are formed by one of a semiconductor laser array and a VCSEL (Vertical Cavity Surface Emitting Laser).

12. The laser driving unit as claimed in claim 1, further comprising:

a threshold current generator configured to generate a threshold current, wherein the driving current further includes, the threshold current.

13. The laser driving unit as claimed in claim 12, wherein the threshold current rises at a first time that is a first predetermined time before a rise of the modulation current and falls at a second time simultaneous with or a second predetermined time after a fall of the modulation current from the rise of the modulation current.

14. The laser driving unit as claimed in claim 13, wherein the threshold current is lower than the modulation current and higher than the bias current, and the driving current is a sum of the bias current and the threshold current at the first time, increases by a sum of the modulation current and the auxiliary driving current at a third time between the first and second times, decreases by the auxiliary driving current at a fourth time between the third and second times, and decreases by a sum of the modulation current and the threshold current at a fifth time that occurs after the fourth time at the fall of the modulation current.

15. An image forming apparatus comprising:

a photoconductive body;

a plurality of light sources configured to emit beams that scan the photoconductive body; and a laser driving unit configured to drive the plurality of light sources, wherein the laser driving unit comprises:

a light detecting unit configured to detect light emissions from the plurality of light sources;

a bias current generator configured to generate a bias current lower than or equal to a threshold current of the plurality of light sources;

a modulation current generator configured to generate a modulation current, to cause light emission of the plurality of light sources, depending on a modulation signal;

an auxiliary driving current generator configured to generate an auxiliary driving current to assist the modulation current during an initial time period of an ON-time of the modulation current, wherein a driving current to drive each of the plurality of light sources includes the bias current, the modulation current, and the auxiliary driving current; and an auxiliary current set unit configured to set an auxiliary amount of the auxiliary driving current to be added to the modulation current, for each of the plurality of light sources, based on a difference between a target light emission of the plurality of light sources and the light emission detected by the light detecting unit when the plurality of light sources are driven by the driving current.

16. The image forming apparatus as claimed in claim 15, wherein the laser driving unit further comprises:

a storage unit configured to store the auxiliary amount set by the auxiliary current set unit, wherein the auxiliary current generator generates the auxiliary driving current to be added to the modulation current based on the auxiliary amount stored in the storage unit.

17. The image forming apparatus as claimed in claim 15, wherein the auxiliary current set unit sets the auxiliary amount by varying the target light emission for each of a plurality of ON-patterns of the plurality of light sources.

18. The image forming apparatus as claimed in claim 15, wherein the auxiliary current set unit sets the auxiliary amount depending on the light emissions of the plurality of light sources in response to a plurality of light emission patterns of the plurality of light sources.

19. The image forming apparatus as claimed in claim 18, wherein the auxiliary current set unit sets the light emission pattern depending on an image quality to be obtained by an image formation using the light emissions from the plurality of light sources.

20. The image forming apparatus as claimed in claim 15, wherein the auxiliary current set unit sets a light emission pattern of the plurality of light sources in order to reduce inconsistencies in light emission among the plurality of light sources.

21. The image forming apparatus as claimed in claim 15, wherein the auxiliary current set unit sets the auxiliary amount depending on a clock frequency for generating pixels of an image to be formed by an image formation using the light emissions from the plurality of light sources.

22. The image forming apparatus as claimed in claim 15, wherein the plurality of light sources form one of a semiconductor laser array and a VCSEL (Vertical Cavity Surface Emitting Laser).

23. The image forming apparatus as claimed in claim 15, wherein the laser driving unit further comprises:

a threshold current generator configured to generate a threshold current, wherein the driving current further includes the threshold current.

24. The image forming apparatus as claimed in claim 23, wherein the threshold current rises at a first time that is a first predetermined time before a rise of the modulation current and falls at a second time simultaneous with or a second predetermined time after a fall of the modulation current from the rise of the modulation current.

25. The image forming apparatus as claimed in claim 24, wherein the threshold current is lower than the modulation current and higher than the bias current, and the driving current is a sum of the bias current and the threshold current at the first time, increases by a sum of the modulation current and the auxiliary driving current at a third time between the first and second times, decreases by the auxiliary driving current at a fourth time between the third and second times, and decreases by a sum of the modulation current and the threshold current at a fifth time that occurs after the fourth time at the fall of the modulation current.

* * * * *